US010220250B2

(12) United States Patent
Luger et al.

(10) Patent No.: US 10,220,250 B2
(45) Date of Patent: Mar. 5, 2019

(54) LOWER BODY MIMETIC EXERCISE DEVICE WITH FULLY OR PARTIALLY AUTONOMOUS RIGHT AND LEFT LEG LINKS AND ERGONOMICALLY POSITIONED PIVOT POINTS

(71) Applicant: Octane Fitness, LLC, Brooklyn Park, MN (US)

(72) Inventors: Nathan R. Luger, Roseville, MN (US); Thomas C. Coy, Saint Michael, MN (US); Mark R. Nestande, Chaska, MN (US); Daniel C. Boyles, Ramsey, MN (US); Charles J. Rosenow, Ramsey, MN (US)

(73) Assignee: Octane Fitness, LLC, Brooklyn Park, MN (US)

( * ) Notice: Subject to any disclaimer, the term of this patent is extended or adjusted under 35 U.S.C. 154(b) by 389 days.

(21) Appl. No.: 15/155,168

(22) Filed: May 16, 2016

(65) Prior Publication Data

US 2016/0256735 A1 Sep. 8, 2016

Related U.S. Application Data

(63) Continuation of application No. 14/468,780, filed on Aug. 26, 2014, now Pat. No. 9,364,708.
(Continued)

(51) Int. Cl.
*A63B 21/008* (2006.01)
*A63B 21/04* (2006.01)
(Continued)

(52) U.S. Cl.
CPC ..... *A63B 22/04* (2013.01); *A63B 21/0083* (2013.01); *A63B 21/0442* (2013.01);
(Continued)

(58) Field of Classification Search
CPC ..... A63B 21/00058; A63B 21/00069; A63B 21/00076; A63B 21/00181; A63B 21/008;
(Continued)

(56) References Cited

U.S. PATENT DOCUMENTS 219,439 A 9/1879 Blend
2,919,494 A * 1/1960 Runci ..... A45D 2/46 34/95.1
(Continued)

FOREIGN PATENT DOCUMENTS

CN 202682672 1/2013
DE 2919494 A1 11/1980
(Continued)

*Primary Examiner* — Gary D Urbiel Goldner
(74) *Attorney, Agent, or Firm* — Sherrill Law Office, PLLC

(57) ABSTRACT

An exercise device having (-) a frame, (-) left and right leg linkages, each including (i) an upper leg member pivotally coupled to the frame for pivoting about an upper pivot point with the upper pivot point of each leg linkage defining a point on a laterally extending upper pivot axis that passes through the upper pivot point of each leg linkage, and (ii) a lower leg member directly pivotally coupled to the upper leg member distal to the upper pivot point for pivoting about a lower pivot point, and (-) a foot support attached to each lower leg member distal to each respective lower pivot point. The invention characterized by an ergonomically synergistic spatial orientation and relationship amongst and between the upper leg members, lower leg members, upper pivot axis, lower pivot axis, hip region of a user, knees of a user, a biased damping means in communication with the lower leg members, and an interconnect member interconnecting the lower leg links with and the biased damping means.

13 Claims, 38 Drawing Sheets

Related U.S. Application Data

(60) Provisional application No. 61/871,710, filed on Aug. 29, 2013.

(51) Int. Cl.

| | |
|---|---|
| ***A63B 21/055*** | (2006.01) |
| ***A63B 22/00*** | (2006.01) |
| ***A63B 22/04*** | (2006.01) |
| ***A63B 22/06*** | (2006.01) |
| ***A63B 23/035*** | (2006.01) |
| ***A63B 23/04*** | (2006.01) |
| ***A63B 71/00*** | (2006.01) |
| ***A63B 23/12*** | (2006.01) |
| *A63B 21/072* | (2006.01) |
| *A63B 21/075* | (2006.01) |

(52) U.S. Cl.
CPC ..... *A63B 21/0552* (2013.01); *A63B 22/001* (2013.01); *A63B 22/0012* (2013.01); *A63B 22/0056* (2013.01); *A63B 22/0664* (2013.01); *A63B 23/03541* (2013.01); *A63B 23/0429* (2013.01); *A63B 23/1209* (2013.01); *A63B 21/075* (2013.01); *A63B 21/0726* (2013.01); *A63B 71/0036* (2013.01); *A63B 2022/0038* (2013.01); *A63B 2022/0051* (2013.01); *A63B 2022/0682* (2013.01); *A63B 2208/0204* (2013.01)

(58) Field of Classification Search
CPC ..... A63B 21/0083; A63B 21/0084; A63B 21/00845; A63B 21/0085; A63B 21/0087; A63B 21/0088; A63B 21/15; A63B 21/158; A63B 21/4027; A63B 21/4033; A63B 21/4034; A63B 21/4045; A63B 22/001; A63B 22/0012; A63B 22/0015; A63B 22/0017; A63B 22/0048; A63B 22/0056; A63B 22/04; A63B 22/06; A63B 22/0664; A63B 2022/002; A63B 2022/0038; A63B 2022/0043; A63B 2022/0051; A63B 2022/0682; A63B 23/03516; A63B 23/03533; A63B 23/03541; A63B 23/03575; A63B 23/04; A63B 23/0405; A63B 23/0429; A63B 23/0482; A63B 23/0494; A63B 23/12; A63B 23/1209; A63B 23/1245; A63B 23/1263; A63B 23/1281; A63B 2023/0452; A63B 69/0028; A63B 69/0035; A63B 69/18; A63B 69/182; A63B 2069/0031; A63B 2069/0033; A63B 71/0054; A63B 2071/0063; A63B 2071/0072; A63B 2071/009; A63B 2208/0204; A63B 2244/19
See application file for complete search history.

(56) References Cited

U.S. PATENT DOCUMENTS 3,316,898 A * 5/1967 Brown ..... A63B 21/00178 482/51
3,316,899 A * 5/1967 Raeder ..... A61H 1/02 601/147
3,970,302 A * 7/1976 McFee ..... A63B 21/008 482/112
3,995,491 A * 12/1976 Wolfla, II ..... A61B 5/221 482/64
4,023,795 A * 5/1977 Pauls ..... A63B 22/0012 482/143
4,053,173 A * 10/1977 Chase, Sr. ..... B62M 1/26 280/238
4,185,622 A * 1/1980 Swenson ..... A61H 1/0266 601/27
4,188,030 A * 2/1980 Hooper ..... A63B 22/001 482/59
4,379,566 A * 4/1983 Titcomb ..... B62K 21/18 280/251
4,456,276 A * 6/1984 Bortolin ..... B62M 1/32 280/257
4,456,279 A * 6/1984 Dirck ..... B60D 1/07 280/416.1
4,470,597 A * 9/1984 McFee ..... A63B 22/0056 482/110
4,496,147 A * 1/1985 DeCloux ..... A63B 21/0083 482/113
4,509,742 A * 4/1985 Cones ..... A63B 22/001 138/45
4,555,109 A * 11/1985 Hartmann ..... A63B 23/0211 482/62
4,561,318 A * 12/1985 Schirrmacher ..... B62M 1/26 280/253
4,679,786 A * 7/1987 Rodgers ..... A63B 21/154 482/54
4,685,666 A * 8/1987 DeCloux ..... A63B 21/0083 482/113
4,708,338 A * 11/1987 Potts ..... A63B 21/023 482/52
4,709,918 A * 12/1987 Grinblat ..... A63B 21/012 482/118
4,720,093 A * 1/1988 Del Mar ..... A63B 21/015 482/52
4,733,858 A * 3/1988 Lan ..... A63B 23/1209 482/113
4,779,863 A * 10/1988 Yang ..... B62M 1/30 280/221
4,786,050 A * 11/1988 Geschwender ..... A63B 22/001 482/57
4,838,543 A * 6/1989 Armstrong ..... A63B 22/0056 482/112
4,850,585 A * 7/1989 Dalebout ..... A63B 21/154 482/118
4,869,494 A * 9/1989 Lambert, Sr. ..... A61H 1/02 482/60
4,900,013 A * 2/1990 Rodgers, Jr. ..... A63B 21/00178 482/6
4,940,233 A * 7/1990 Bull ..... A63B 21/154 482/112
4,949,954 A * 8/1990 Hix ..... A63B 21/018 482/60
4,949,993 A * 8/1990 Stark ..... A63B 21/153 482/52
4,951,942 A * 8/1990 Walden ..... A63B 21/04 482/130
4,989,857 A * 2/1991 Kuo ..... A61H 1/0255 482/52
5,000,442 A * 3/1991 Dalebout ..... A63B 21/018 482/120
5,000,443 A * 3/1991 Dalebout ..... A63B 21/154 482/114
5,038,758 A * 8/1991 Iams ..... A61H 1/008 482/57
5,039,087 A * 8/1991 Kuo ..... A61H 1/0255 482/52
5,039,088 A * 8/1991 Shifferaw ..... A63B 21/154 482/118
5,040,786 A * 8/1991 Jou ..... A63B 22/0056 482/128
5,048,821 A * 9/1991 Kuo-Liang ..... A63B 22/0056 482/53
5,062,627 A * 11/1991 Bingham ..... A63B 21/05 482/53
5,072,928 A * 12/1991 Stearns ..... A63B 22/0221 482/54
5,129,872 A * 7/1992 Dalton ..... A63B 21/026 482/127

(56) References Cited

U.S. PATENT DOCUMENTS 5,131,895 A * 7/1992 Rogers, Jr. ..... A63B 22/0005 482/70
5,135,447 A * 8/1992 Robards, Jr. ..... A63B 21/157 482/52
5,149,312 A * 9/1992 Croft ..... A63B 22/0605 482/148
5,186,697 A * 2/1993 Rennex ..... A63B 21/00178 482/52
5,195,935 A * 3/1993 Fencel ..... A63B 21/00178 482/52
5,242,343 A * 9/1993 Miller ..... A63B 21/015 482/51
5,279,529 A * 1/1994 Eschenbach ..... A63B 21/4049 482/51
5,279,530 A * 1/1994 Hess ..... A63B 21/0552 482/121
5,290,211 A * 3/1994 Stearns ..... A63B 21/00178 482/51
5,295,928 A * 3/1994 Rennex ..... A63B 21/00178 482/51
5,299,993 A * 4/1994 Habing ..... A63B 21/023 482/51
5,336,141 A * 8/1994 Vittone ..... A63B 22/001 482/130
5,352,169 A * 10/1994 Eschenbach ..... A63B 22/0664 482/51
5,383,829 A 1/1995 Miller
5,401,226 A 3/1995 Stearns
5,419,747 A * 5/1995 Piaget ..... A63B 22/001 434/255
5,423,729 A * 6/1995 Eschenbach ..... A63B 22/001 482/51
5,496,235 A * 3/1996 Stevens ..... A63B 21/015 434/255
5,499,956 A 3/1996 Habings et al.
5,518,473 A * 5/1996 Miller ..... A63B 22/0664 482/51
5,527,246 A * 6/1996 Rodgers, Jr. ..... A63B 22/001 280/253
5,529,554 A * 6/1996 Eschenbach ..... A63B 22/0664 482/57
5,529,555 A * 6/1996 Rodgers, Jr. ..... A63B 22/001 482/51
5,538,486 A * 7/1996 France ..... A63B 21/0004 177/245
5,540,637 A * 7/1996 Rodgers, Jr. ..... A63B 22/001 482/51
5,549,526 A * 8/1996 Rodgers, Jr. ..... A63B 22/001 482/51
5,573,480 A * 11/1996 Rodgers, Jr. ..... A63B 22/001 482/51
5,577,985 A * 11/1996 Miller ..... A63B 21/00178 482/51
5,584,780 A * 12/1996 Lin ..... A63B 22/001 482/51
5,593,372 A * 1/1997 Rodgers, Jr. ..... A63B 22/001 482/51
5,595,553 A * 1/1997 Rodgers, Jr. ..... A63B 22/001 482/51
5,611,756 A * 3/1997 Miller ..... A63B 21/00178 482/51
5,637,058 A 6/1997 Rogers, Jr.
5,735,773 A * 4/1998 Vittone ..... A63B 22/001 482/37
5,746,681 A * 5/1998 Bull ..... A63B 22/0056 482/51
5,769,760 A * 6/1998 Lin ..... A63B 22/001 482/51
5,788,610 A * 8/1998 Eschenbach ..... A63B 22/001 482/51
5,792,026 A * 8/1998 Maresh ..... A63B 22/001 482/51
5,792,027 A * 8/1998 Gvoich ..... A63B 22/001 482/51
5,792,028 A * 8/1998 Jarvie ..... A63B 22/001 482/51
5,792,029 A * 8/1998 Gordon ..... A63B 22/001 482/52
5,813,949 A 9/1998 Rogers, Jr.
5,857,940 A * 1/1999 Husted ..... A63B 22/001 482/51
5,876,308 A * 3/1999 Jarvie ..... A63B 21/154 482/51
5,910,072 A * 6/1999 Rawls ..... A63B 21/0053 482/51
5,911,649 A 6/1999 Miller
5,967,944 A * 10/1999 Vittone ..... A63B 22/001 482/37
6,004,244 A * 12/1999 Simonson ..... A63B 21/153 482/51
6,036,622 A * 3/2000 Gordon ..... A63B 21/154 482/51
6,045,487 A * 4/2000 Miller ..... A63B 21/00178 482/51
6,152,859 A * 11/2000 Stearns ..... A63B 22/001 482/52
6,183,397 B1 * 2/2001 Stearns ..... A63B 22/001 482/51
6,368,252 B1 4/2002 Stearns
6,390,953 B1 * 5/2002 Maresh ..... A63B 22/0664 482/51
D476,046 S * 6/2003 Wang ..... D21/694
7,226,390 B2 6/2007 Stearns
7,285,075 B2 * 10/2007 Cutler ..... A63B 22/0023 482/54
D555,743 S * 11/2007 Wang ..... D21/694
7,520,839 B2 * 4/2009 Rodgers, Jr. ..... A63B 22/001 482/51
7,530,926 B2 * 5/2009 Rodgers, Jr. ..... A63B 22/001 482/51
7,608,018 B2 * 10/2009 Chuang ..... A63B 22/001 482/52
7,645,215 B2 * 1/2010 Gordon ..... A63B 22/0017 482/51
7,678,025 B2 * 3/2010 Rodgers, Jr. ..... A63B 21/151 482/52
7,708,669 B2 5/2010 Rogers, Jr.
7,828,698 B2 5/2010 Rogers, Jr.
7,833,134 B2 11/2010 Gordon
7,862,482 B1 * 1/2011 Hsu ..... A63B 22/001 482/51
D640,337 S * 6/2011 Liu ..... D21/666
8,082,029 B2 * 12/2011 Honda ..... A61B 5/0245 482/54
8,109,861 B2 * 2/2012 Gordon ..... A61H 1/0237 482/51
8,409,058 B2 4/2013 Gordon et al.
D703,278 S * 4/2014 Horita ..... D21/668
9,050,491 B2 6/2015 Gordon et al.
2002/0049121 A1 * 4/2002 Anderson ..... A63B 22/02 482/51
2003/0092532 A1 * 5/2003 Giannelli ..... A63B 22/0056 482/51
2004/0224825 A1 * 11/2004 Giannelli ..... A63B 21/225 482/52
2005/0054488 A1 * 3/2005 Husted ..... A63B 22/001 482/51
2006/0189454 A1 * 8/2006 Bull ..... A63B 21/15 482/71
2008/0132385 A1 * 6/2008 Alessandri ..... A63B 22/001 482/52
2008/0287265 A1 * 11/2008 Giannelli ..... A63B 22/001 482/52
2009/0203501 A1 * 8/2009 Rodgers, Jr. ..... A63B 22/001 482/52
2010/0093498 A1 * 4/2010 Fenster ..... A63B 22/001 482/52

(56) References Cited

U.S. PATENT DOCUMENTS

| | | | | |
|---|---|---|---|---|
| 2010/0160115 | A1* | 6/2010 | Morris | A63B 22/0235 482/4 |
| 2010/0267524 | A1* | 10/2010 | Stewart | A63B 22/001 482/52 |
| 2011/0028275 | A1* | 2/2011 | Stewart | A63B 22/001 482/52 |
| 2014/0148311 | A1* | 5/2014 | Eschenbach | A63B 22/0017 482/52 |

FOREIGN PATENT DOCUMENTS

| | | | |
|---|---|---|---|
| DE | 10060466 | A1 | 6/2002 |
| EP | 2000178 | A1 | 12/2008 |
| WO | 2008124025 | A1 | 10/2008 |

* cited by examiner

LOWER BODY MIMETIC EXERCISE DEVICE WITH FULLY OR PARTIALLY AUTONOMOUS RIGHT AND LEFT LEG LINKS AND ERGONOMICALLY POSITIONED PIVOT POINTS

BACKGROUND

The fitness industry has long desired a stationary, low-impact, exercise machine capable of adapting and conforming to a user's natural gait, stride and pace (hereinafter "user conforming exercise machine") during exercise. Treadmills accommodate user-defined gait and stride (i.e., uncontrolled path of travel), but are high-impact with machine-dictated pace. Elliptical exercise machines are low-impact and accommodate user-defined pace, but have machine-dictated gait and stride (i.e., defined path of travel).

Several attempts have been made to achieve a user-conforming exercise machine by employing leg linkages that mimic human legs (i.e., an exercise machine having a stationary frame supporting a pair of leg linkages with each leg linkage having (i) an upper link pivotally coupled proximate its upper end to the frame, (ii) a lower link pivotally coupled proximate its upper end to the lower end of the upper link, and (iii) a foot support on the lower end of each lower link). Exemplary lower body mimetic stationary exercise machines are depicted and described in U.S. Pat. Nos. 5,290,211, 5,499,956, 5,735,773, 5,911,649, 6,036,622, 6,045,487, 6,152,859 (FIG. 29), U.S. Pat. Nos. 7,645,215, 7,833,134, 8,109,861, and 8,409,058, the disclosures of which are hereby incorporated by reference. While constituting a significant advance towards achieving a user-conforming exercise machine, these lower body mimetic stationary exercise machines have met with limited commercial success as they exert active and reactive forces that do not coordinate well with a user's innately anticipated natural interaction with the environment during walking or running.

Accordingly, a need continues to exist for a stationary user-conforming exercise machine that ergonomically conforms to the natural innate striding motion of the user.

SUMMARY OF THE INVENTION

The invention is directed to a variable gait exercise device with fully or partially autonomous right and left leg links and ergonomically positioned hip and/or knee pivot points.

A stationary lower body mimetic exercise machine capable of providing a versatile foot support motion that conforms to the natural, innate and ergonomic striding motion of the user, as opposed to influencing a user into a machine chosen striding motion, can be achieved by providing the machine with left-right autonomous thigh and/or calf links with ergonomically aligned hip and/or calf pivot points, with each combination of autonomy and ergonomic alignment possessing certain unique subtle refinements in interaction between the machine and its human operator.

In a first aspect, the exercise machine is a stationary lower body mimetic exercise machine wherein (i) user orientation on the machine is determined by at least one of (-) configuring the frame to accommodate user access onto the exercise machine from the rearward end of the frame, and (-) providing a display mounted to the frame for displaying information viewable by a forward facing orthostatic user supported upon the foot supports, (ii) the first and second hip pivot points define a laterally extending upper pivot axis, (iii) the left and right leg linkages selectively interact such that at least one of (-) the thigh members pivot autonomously relative to one another about the hip pivot points while the calf members are interconnected for synchronized out of phase pivoting about the knee pivot points, and (-) the calf members pivot autonomously relative to one another about the knee pivot points while the thigh members are interconnected for synchronized out of phase pivoting about the hip pivot points, and (iv) the thigh members, calf members and foot supports are supported, configured and arranged such that the upper pivot axis will pass through or posterior to the hip region of an orthostatic forward facing suited user supported upon the foot supports with the foot supports horizontally and vertically aligned.

In a first embodiment of the first aspect of the invention, the thigh members pivot autonomously relative to one another about the hip pivot points while the calf members are interconnected for synchronized out of phase pivoting about the knee pivot points.

In a second embodiment of the first aspect of the invention, the calf members pivot autonomously relative to one another about the knee pivot points while the thigh members are interconnected for synchronized out of phase pivoting about the hip pivot points.

In a third embodiment of the first aspect of the invention, the left leg linkage and the right leg linkage pivot autonomously relative to one another about both the hip pivot points and the knee pivot points.

In an alternative portrayal, the third embodiment has (i) thigh members that pivot autonomously relative to one another about their respective hip pivot points, and (ii) calf members that pivot autonomously relative to one another about their respective knee pivot points.

In a second aspect, the exercise machine is a stationary lower body mimetic exercise machine wherein (i) user orientation on the machine is determined by at least one of (-) configuring the frame to accommodate user access onto the exercise machine from the rearward end of the frame, and (-) providing a display mounted to the frame for displaying information viewable by a forward facing orthostatic user supported upon the foot supports, (ii) the left and right leg linkages selectively interact such that at least one of (-) the thigh members pivot autonomously relative to one another about the hip pivot points while the calf members are interconnected for synchronized out of phase pivoting about the knee pivot points, and (-) the calf members pivot autonomously relative to one another about the knee pivot points while the thigh members are interconnected for synchronized out of phase pivoting about the hip pivot points, and (iii) the thigh members, calf members and foot supports are supported, configured and arranged such that the first and second lower pivot axis are each positioned proximate one of the knees of an orthostatic forward facing suited user supported upon the foot supports with the foot supports horizontally and vertically aligned.

In a first embodiment of the second aspect of the invention, the thigh members pivot autonomously relative to one another about the hip pivot points while the calf members are interconnected for synchronized out of phase pivoting about the knee pivot points.

In a second embodiment of the second aspect of the invention, the calf members pivot autonomously relative to one another about the knee pivot points while the thigh members are interconnected for synchronized out of phase pivoting about the hip pivot points.

In a third embodiment of the second aspect of the invention, the left leg linkage and the right leg linkage pivot autonomously relative to one another about both the hip pivot points and the knee pivot points.

In an alternative portrayal, the third embodiment has (i) thigh members that pivot autonomously relative to one another about their respective hip pivot points, and (ii) calf members that pivot autonomously relative to one another about their respective knee pivot points.

In a third aspect, the exercise machine is a stationary lower body mimetic exercise machine wherein (i) user orientation on the machine is determined by at least one of (-) configuring the frame to accommodate user access onto the exercise machine from the rearward end of the frame, and (-) providing a display mounted to the frame for displaying information viewable by a forward facing orthostatic user supported upon the foot supports, (ii) the first and second hip pivot points define a laterally extending upper pivot axis, (iii) the left and right leg linkages selectively interact such that at least one of (-) the thigh members pivot autonomously relative to one another about the hip pivot points while the calf members are interconnected for synchronized out of phase pivoting about the knee pivot points, and (-) the calf members pivot autonomously relative to one another about the knee pivot points while the thigh members are interconnected for synchronized out of phase pivoting about the hip pivot points, and (iii) the thigh members, calf members and foot supports are supported, configured and arranged such that the upper pivot axis passes through or posterior to the hip region and the first and second lower pivot axis are each positioned proximate one of the knees, both in relation to an orthostatic forward facing suited user supported upon the foot supports with the foot supports horizontally and vertically aligned.

In a first embodiment of the third aspect of the invention, the thigh members pivot autonomously relative to one another about the hip pivot points while the calf members are interconnected for synchronized out of phase pivoting about the knee pivot points.

In a second embodiment of the third aspect of the invention, the calf members pivot autonomously relative to one another about the knee pivot points while the thigh members are interconnected for synchronized out of phase pivoting about the hip pivot points.

In a third embodiment of the third aspect of the invention, the left leg linkage and the right leg linkage pivot autonomously relative to one another about both the hip pivot points and the knee pivot points.

In an alternative portrayal, the third embodiment has (i) thigh members that pivot autonomously relative to one another about their respective hip pivot points, and (ii) calf members that pivot autonomously relative to one another about their respective knee pivot points.

BRIEF DESCRIPTION OF THE DRAWINGS

Each Figure depicts the components of the invention represented therein in proper proportion to one another. Those Figures which include depiction of a human supported upon the foot supports of the invention depict the machine in proper proportion to the human, who is 6 feet 2 inches tall, has an inseam of 32 inches, weighs 178 pounds, and wears a size 9.5 US shoe.

DETAILED DESCRIPTION OF A PREFERRED EMBODIMENT

Definitions

Figure 1:
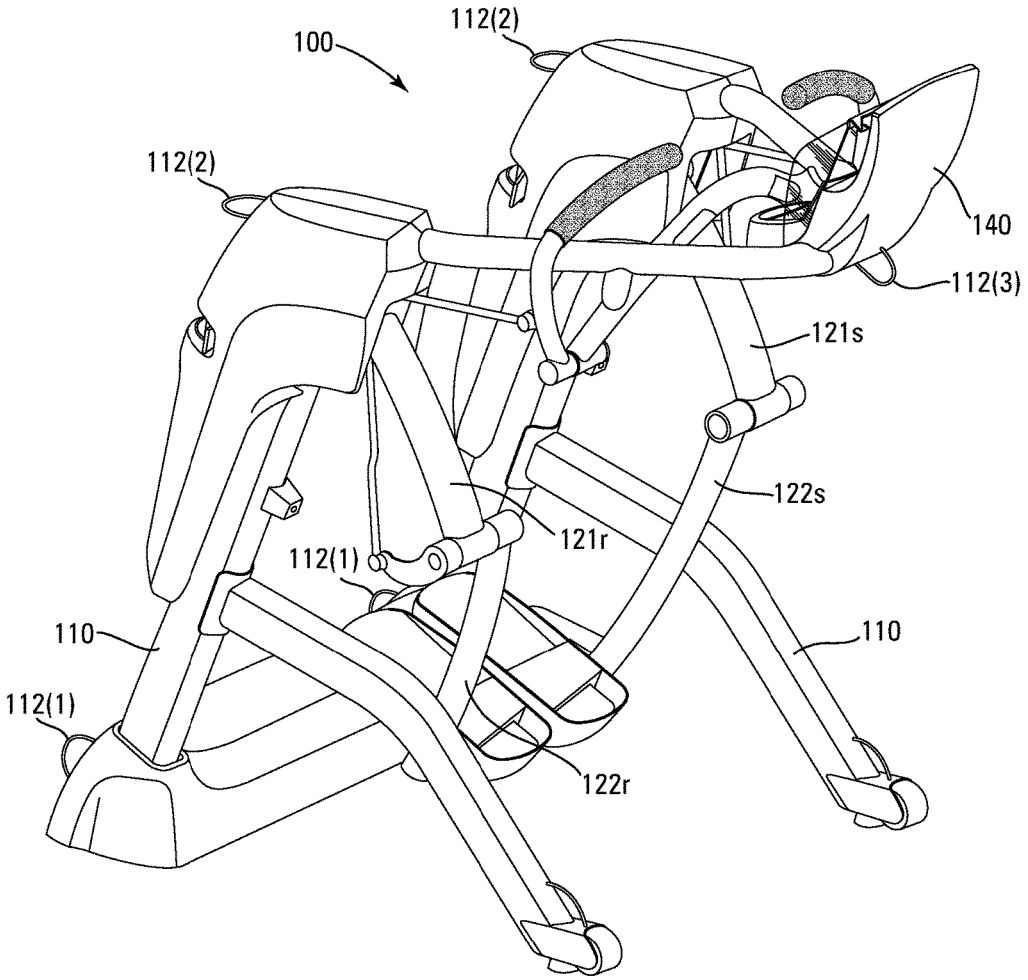
FIG. 1 is a front isometric view of one embodiment of the invention.

As utilized herein, including the claims, the term "rest position" means the position of the leg links when an orthostatic forward facing user is supported solely by and upon the foot supports with the foot supports horizontally and vertically aligned.

As utilized herein, including the claims, the term "suited user" means a user whose physique is suited for ergonomic exercising on a defined exercise machine.

As utilized herein, including the claims, the phrase "positioned proximate a knee" means within a four inch parasagittal plane radius from the forwardmost surface of the patella, without regard to left-right lateral distance.

As utilized herein, including the claims, a "stationary lower body mimetic exercise machine" refers to an exercise machine having a stationary frame supporting a pair of leg linkages (i.e., left and right leg linkages), with each leg linkage having (i) an upper or thigh link pivotally coupled proximate its upper end to the frame at an upper or hip pivot point, (ii) a lower or calf link pivotally coupled proximate its upper end to the lower end of the thigh link at a lower or knee pivot point, and (iii) a foot support on the lower end of each calf link configured for supporting a user in a standing position during exercise.

NOMENCLATURE

100 Exercise Machine
100*a* Forward End of Exercise Machine
100*b* Rearward End of Exercise Machine
110 Frame
110*r* Right-Side Stanchion
110*s* Left-Side Stanchion
110*t* Step-Over Support Beam
110*h* Horizontal Looped Handrail
110*v* Vertical Looped Cross Beam Handrail
110*w* Support Legs
112 D-Rings
112$_1$ D-Ring Proximate Lower End of Each Stanchion
112$_2$ D-Ring Proximate Upper End of Each Stanchion
112$_3$ D-Ring Proximate Lateral Center of Handrail
114 Free-Weight Support Shelf
116 Thigh Member Stop
118*r* Protective Shroud Over Right Leg Linkage Power Transmission Hub
118*s* Protective Shroud Over Left Leg Linkage Power Transmission Hub
118*t* Protective Shroud Over Transfer Bar
119 Access Opening in Frame
120 Leg Linkage
120*r* Right Leg Link
120*s* Left Leg Link
121 Thigh Member of Leg Links
121*a* Upper End of Thigh Members
121*b* Lower End of Thigh Members
121*r* Right Thigh Member
121*s* Left Thigh Member
121*t*$_1$ First Tab Extending from Upper End of Thigh Members
121*t*$_2$ Second Tab Extending from Upper End of Thigh Members
122 Calf Member of Leg Links
122*a* Upper End of Calf Members
122*b* Lower End of Calf Members
122*r* Right Calf Member
122*s* Left Calf Member
123 Calf Member Extension Arm
123*r* Right Calf Member Extension Arm
123*s* Left Calf Member Extension Arm
124 Foot Supports
124*r* Right Foot Support
124*s* Left Foot Support
130 Power Transmission Systems
131 Thigh Articulator Members
131*r* Right Thigh Articulator Member
131*r*$_1$ First End of Right Thigh Articulator Member
131*r*$_2$ Second End of Right Thigh Articulator Member
131*s* Left Thigh Articulator Member
131*s*$_1$ First End of Left Thigh Articulator Member
131*s*$_2$ Second End of Left Thigh Articulator Member
131*t* Center Pivot Thigh Motion Transfer Bar
131*t*$_1$ First End of Thigh Motion Transfer Bar
131*t*$_2$ Second End of Thigh Motion Transfer Bar

Figure 2:
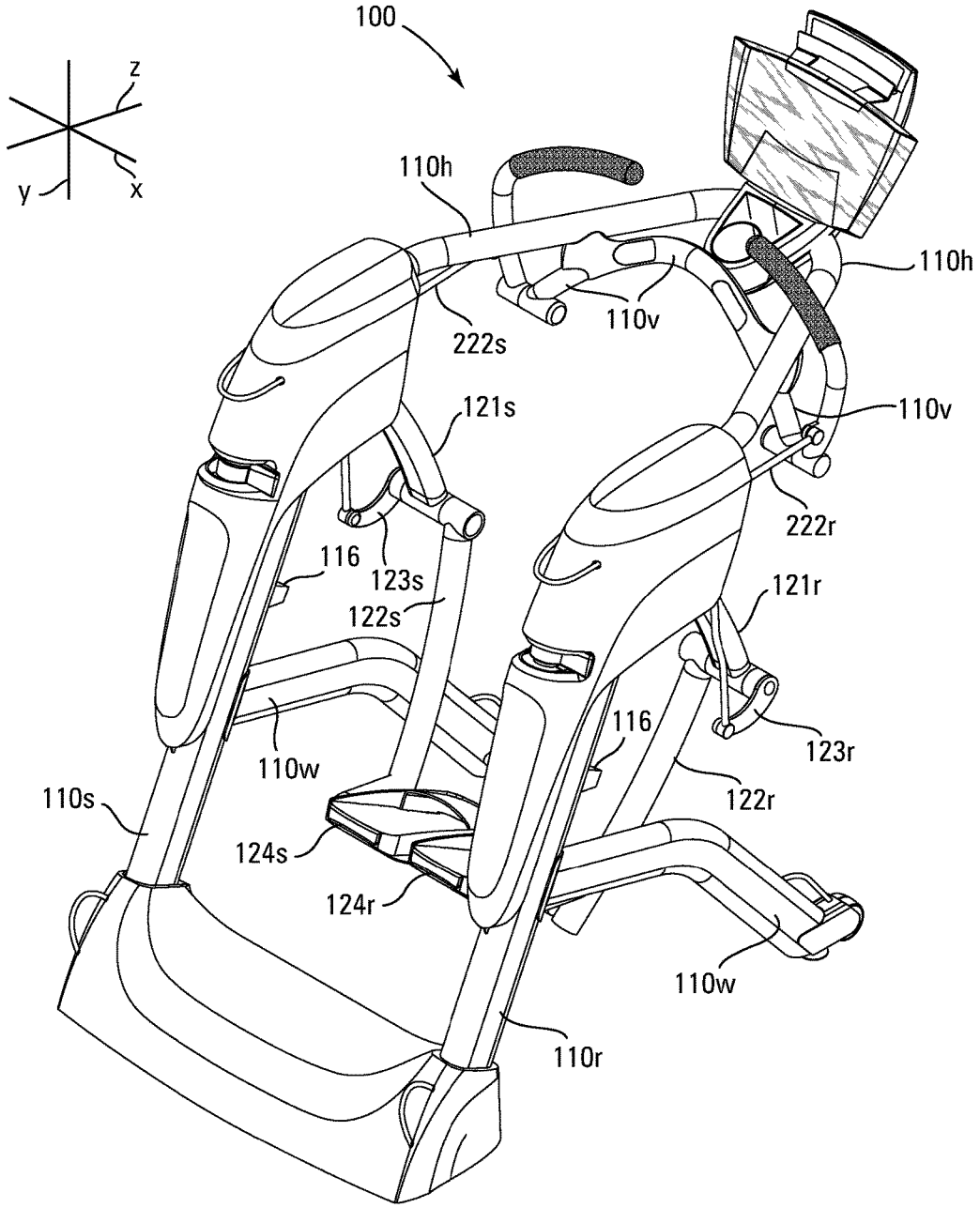
FIG. 2 is a rear isometric view of the invention depicted in FIG. 1.
Figure 3:
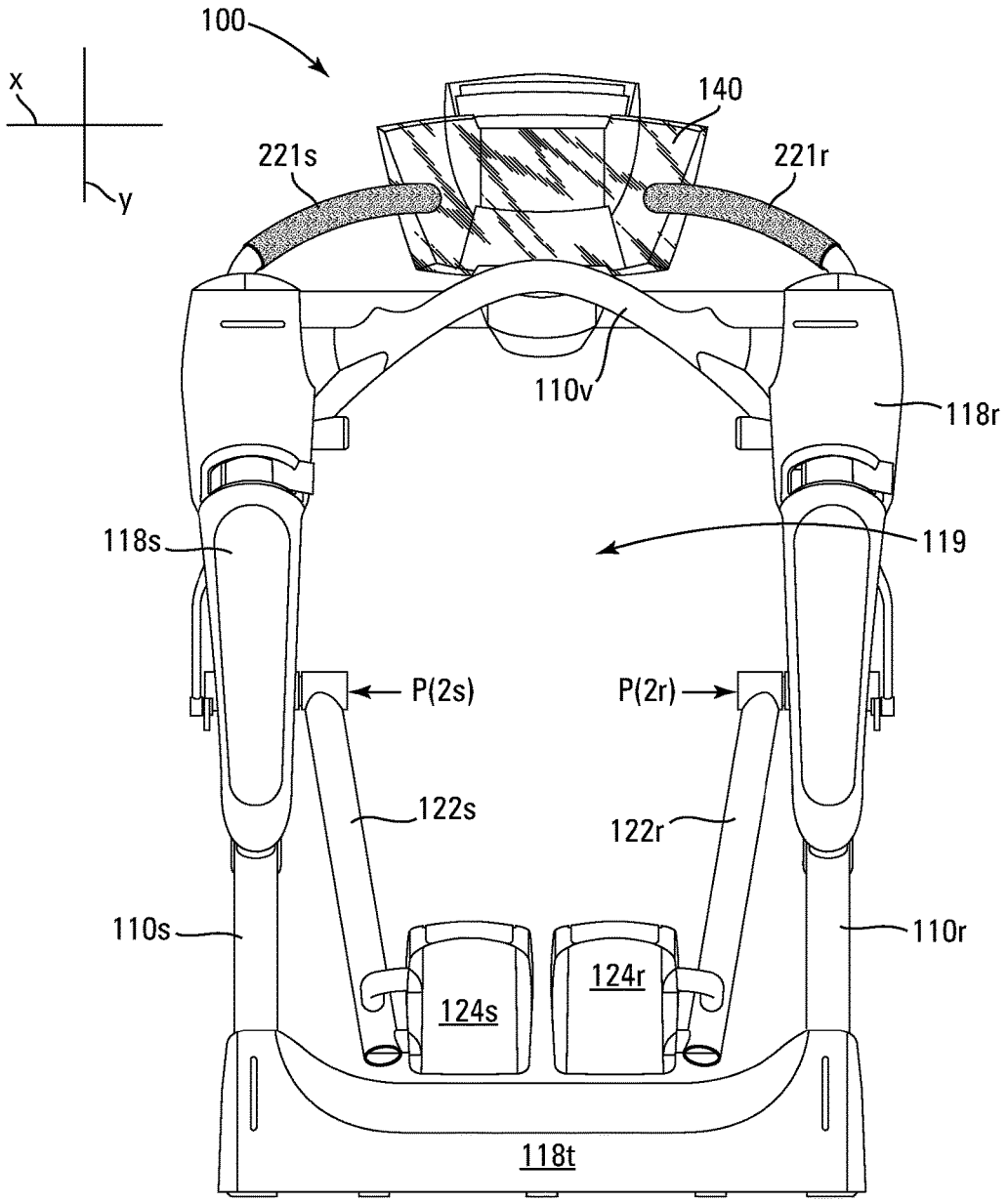
FIG. 3 is a rear view of the invention depicted in FIG. 1.
Figure 4:
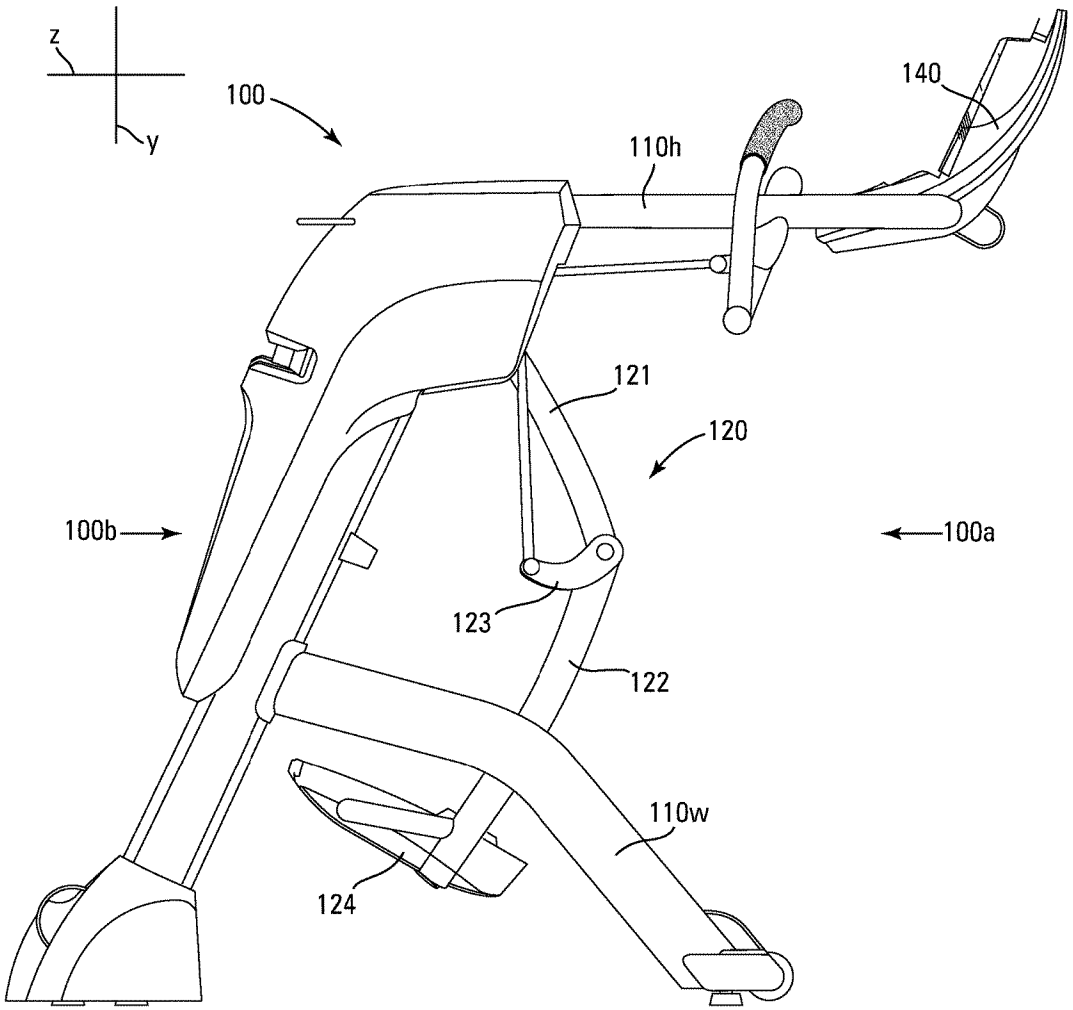
FIG. 4 is a right-side view of the invention depicted in FIG. 1.
Figure 5:
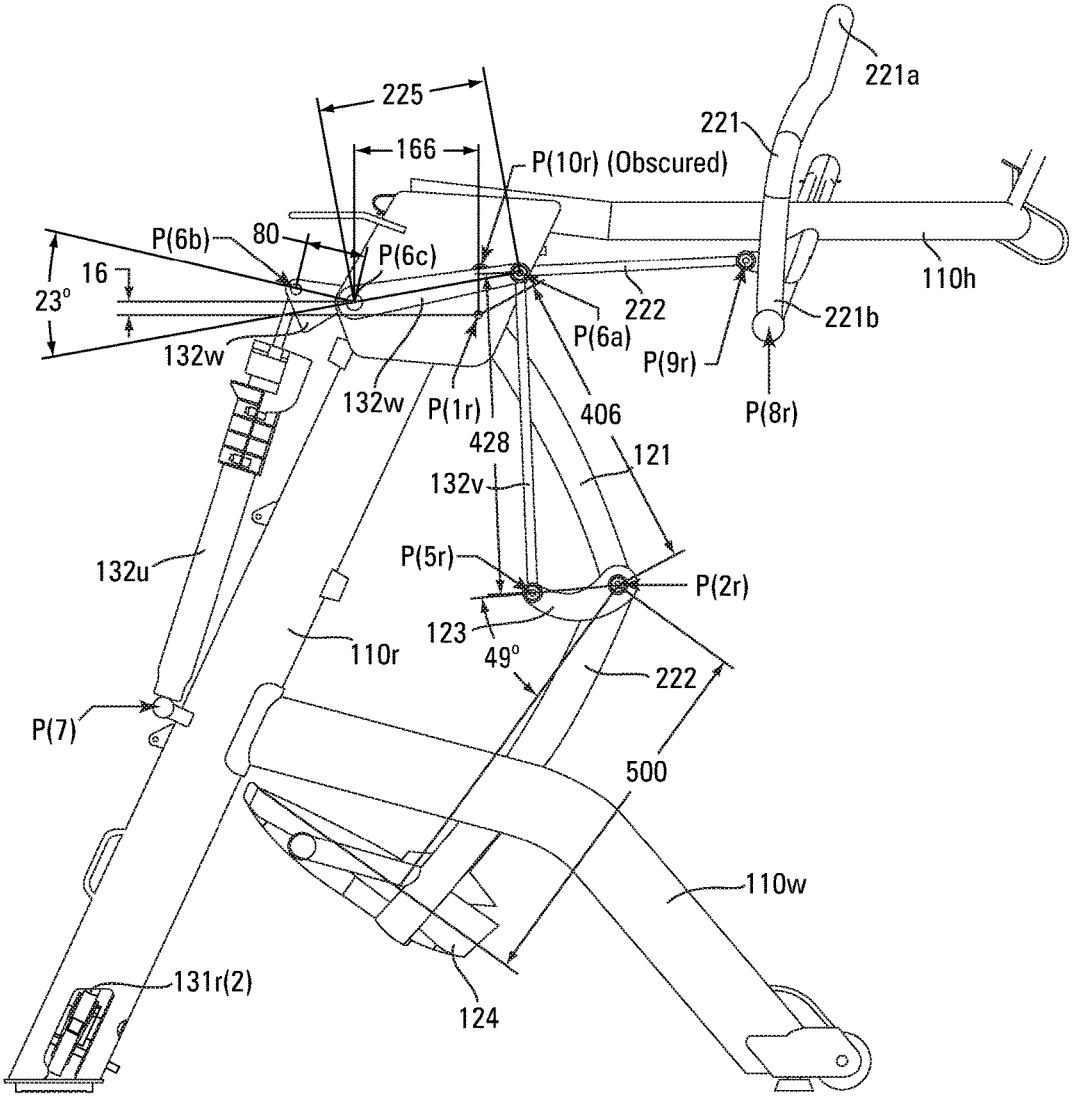
FIG. 5 is a right-side view of the invention depicted in FIG. 1 with exemplary dimensions wherein distance is in millimeters and angles are in degrees.
Figure 6:
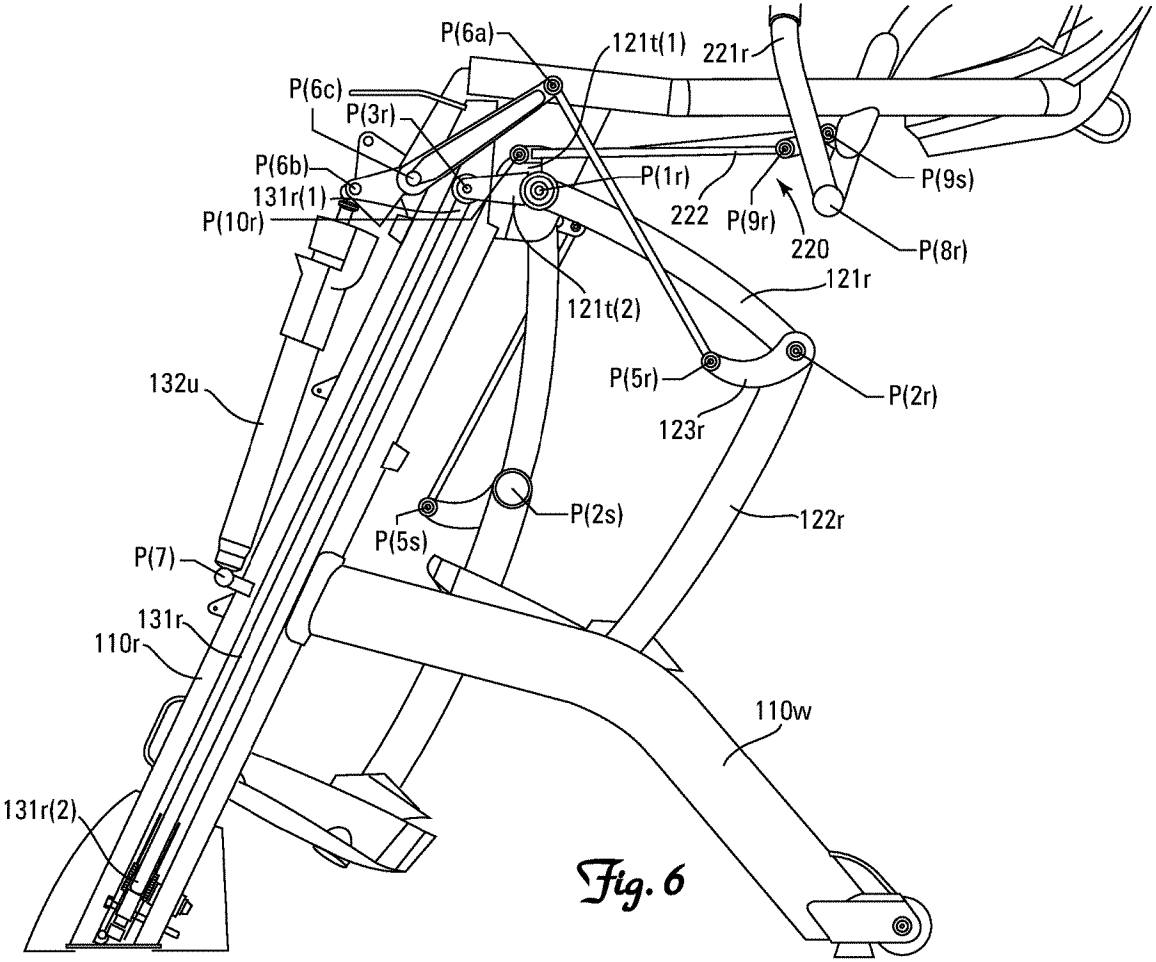
FIG. 6 is a right-side view of the invention depicted in FIG. 1 with portions of the frame removed to facilitate viewing of internal components.
Figure 7:
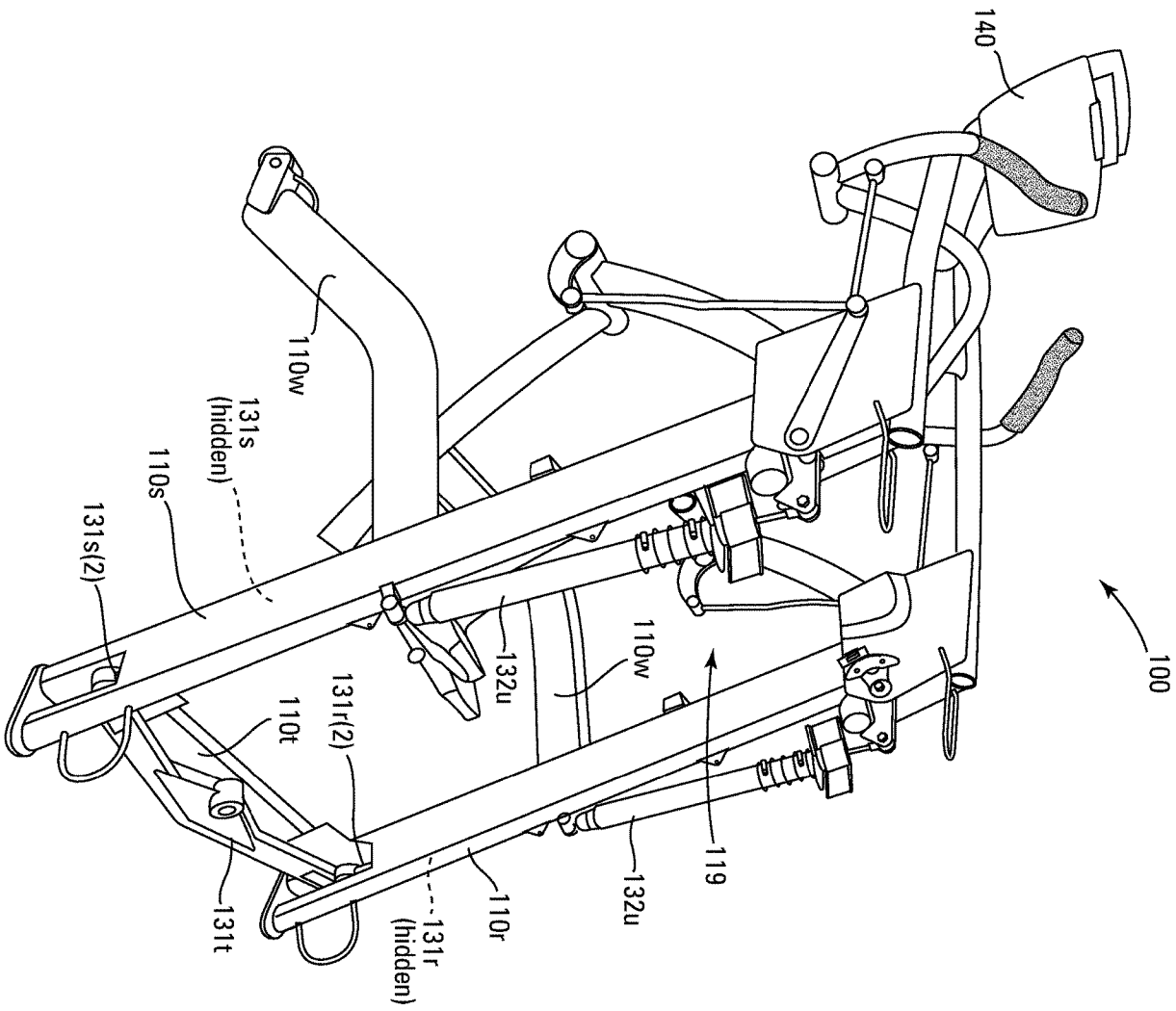
FIG. 7 is a rear isometric view of the invention depicted in FIG. 1 with protective shrouding removed to facilitate viewing of internal components.
Figure 8:
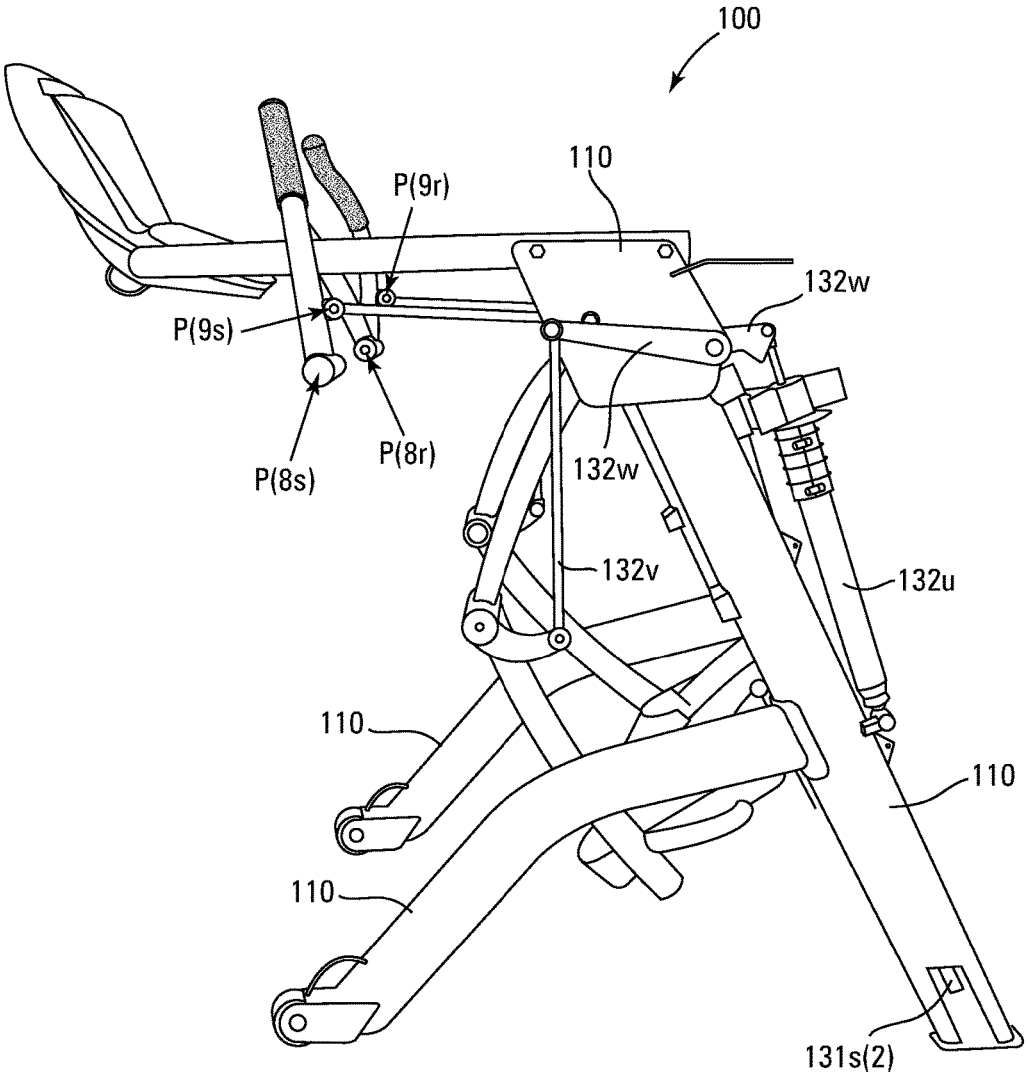
FIG. 8 is a left-side view of the invention depicted in FIG. 7.
Figure 9:
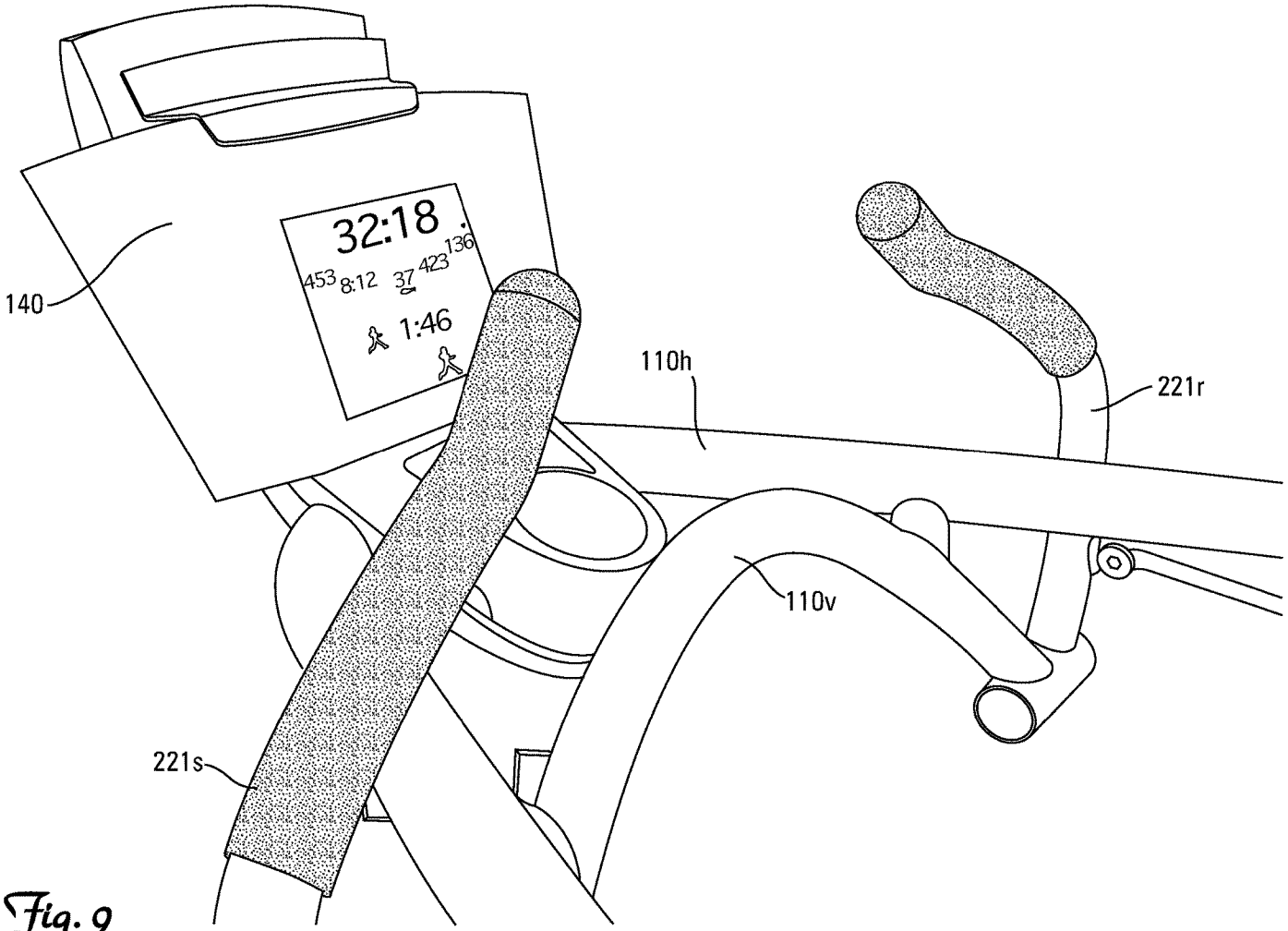
FIG. 9 is a close-up rear isometric view of the forward portion of the invention depicted in FIG. 7, including the control console, arm linkages and handrail.
Figure 10:
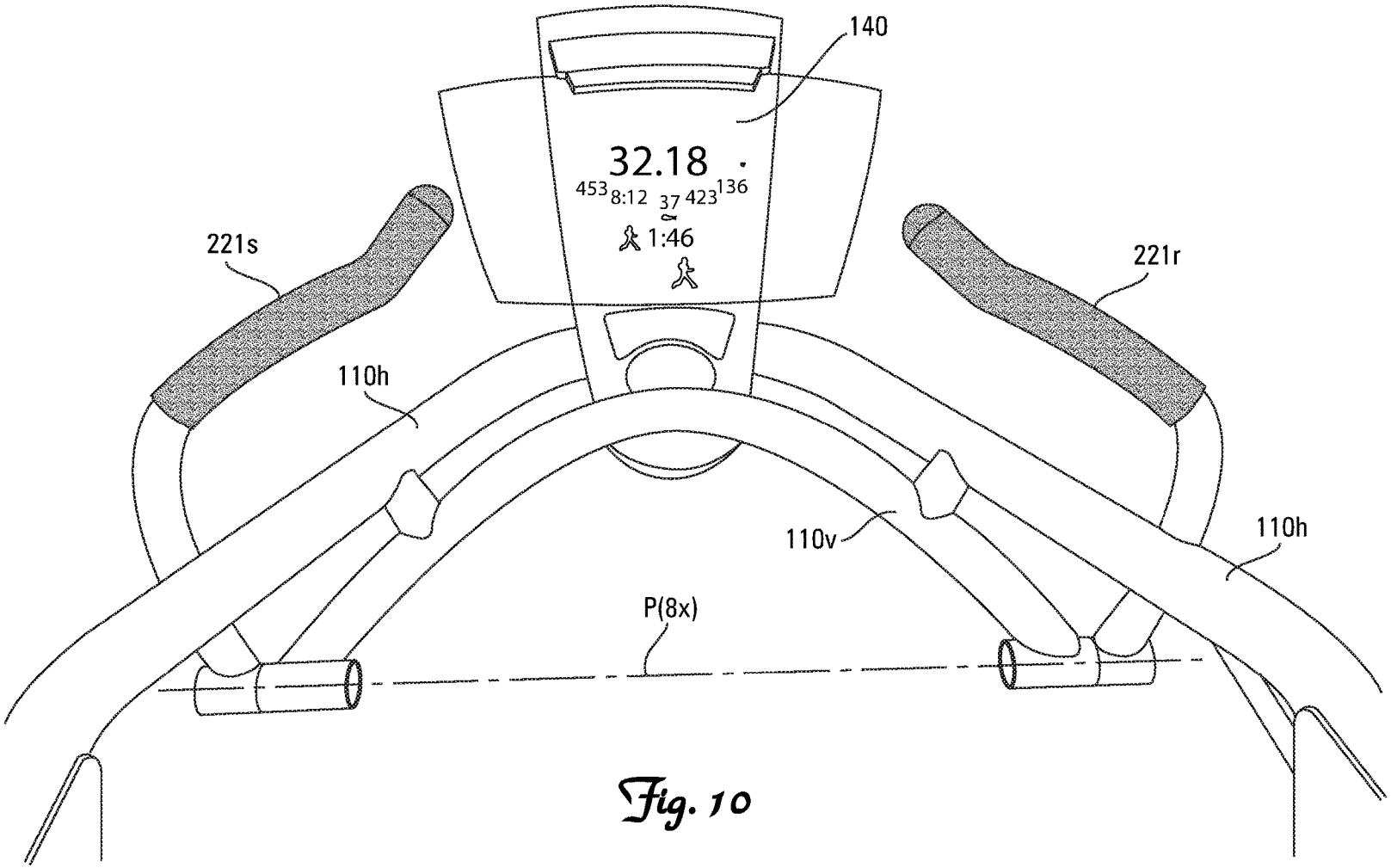
FIG. 10 is the forward portion of the invention depicted in FIG. 9 as viewed by a person using the exercise machine.
Figure 11:
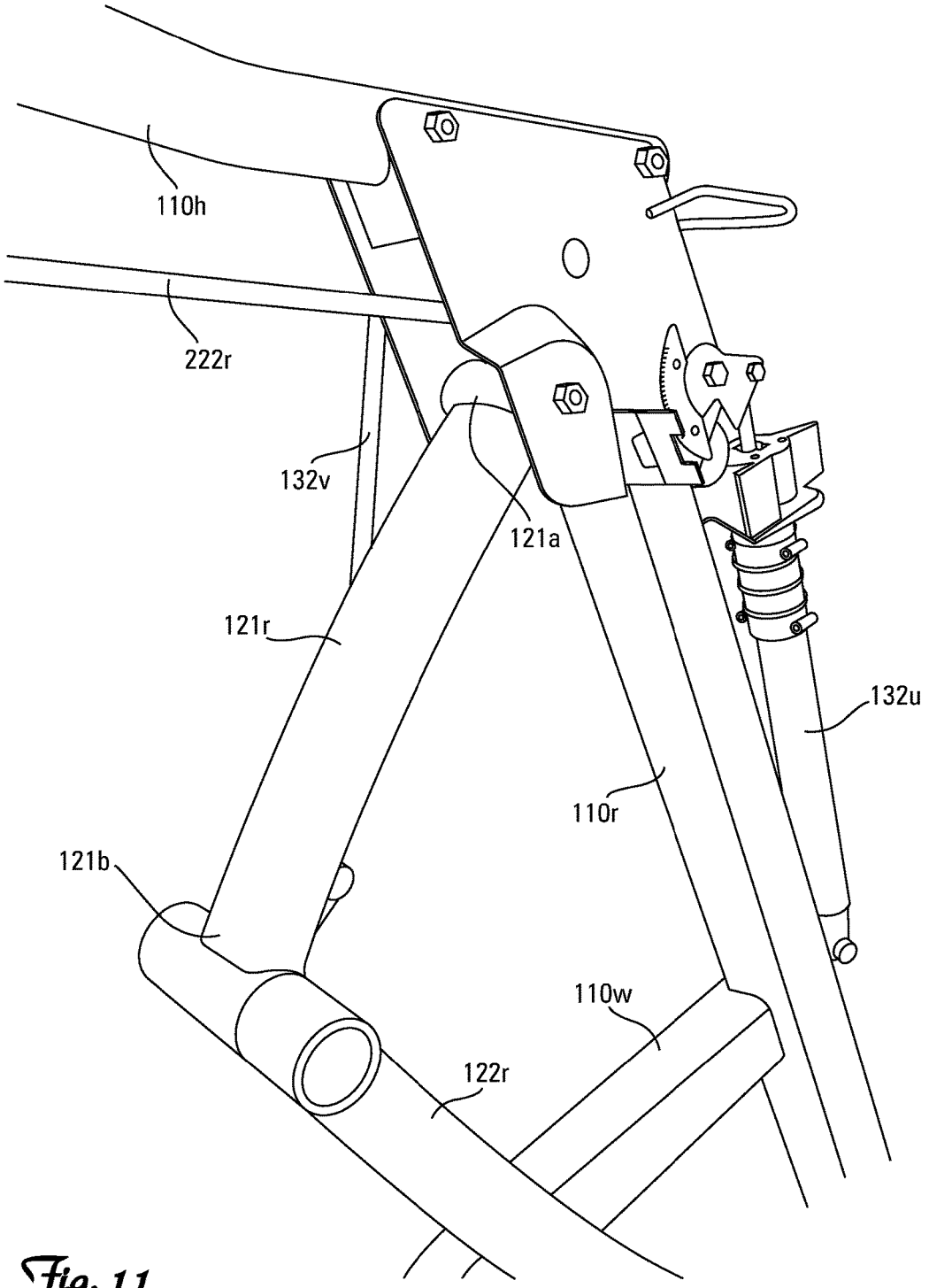
FIG. 11 is a close-up, internal front isometric view of the right-side, pivot-manifold area of the invention depicted in FIG. 7.
Figure 12:
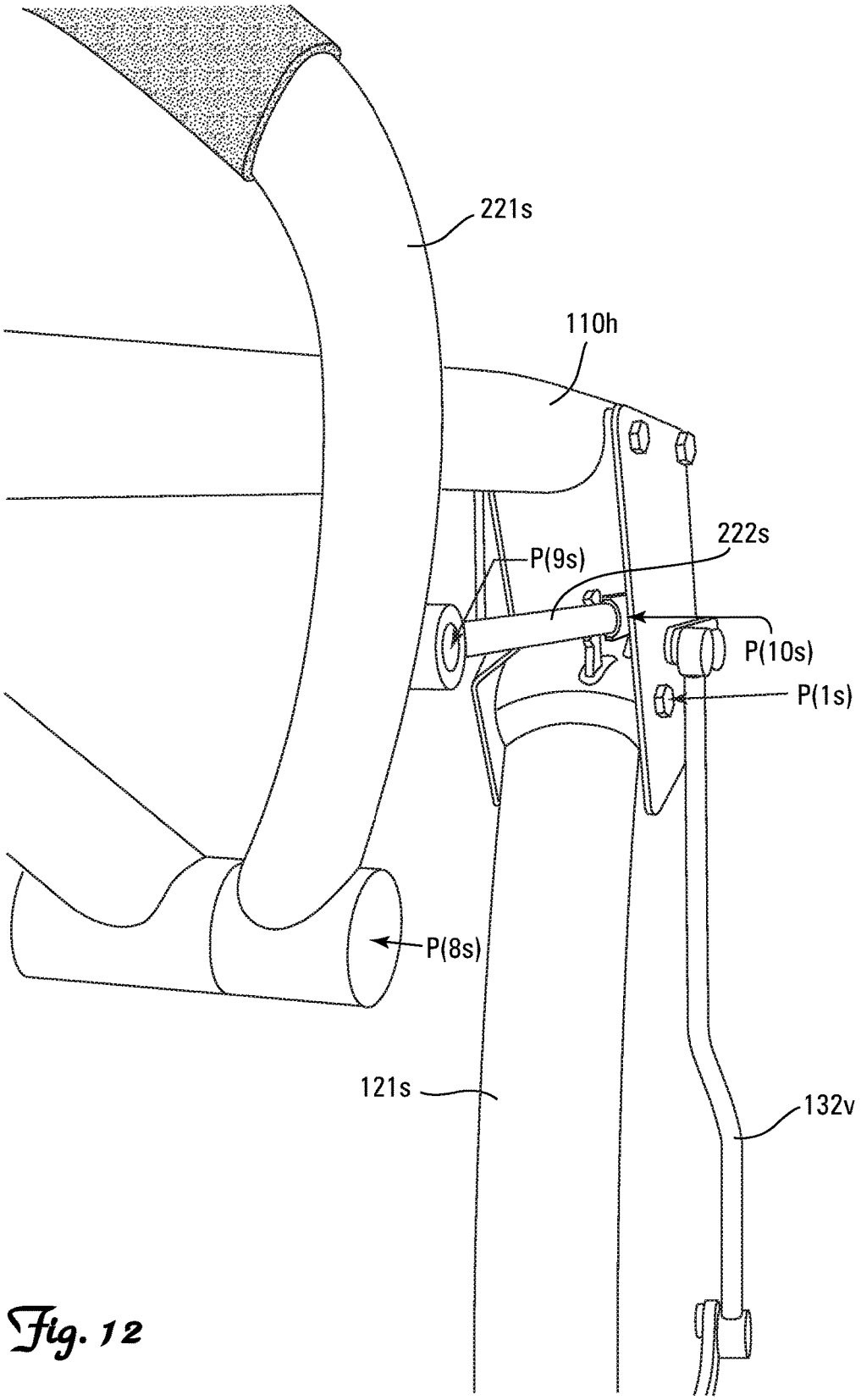
FIG. 12 is a close-up, front isometric view of the left-side, pivot-manifold area of the invention depicted in FIG. 7.
Figure 13:
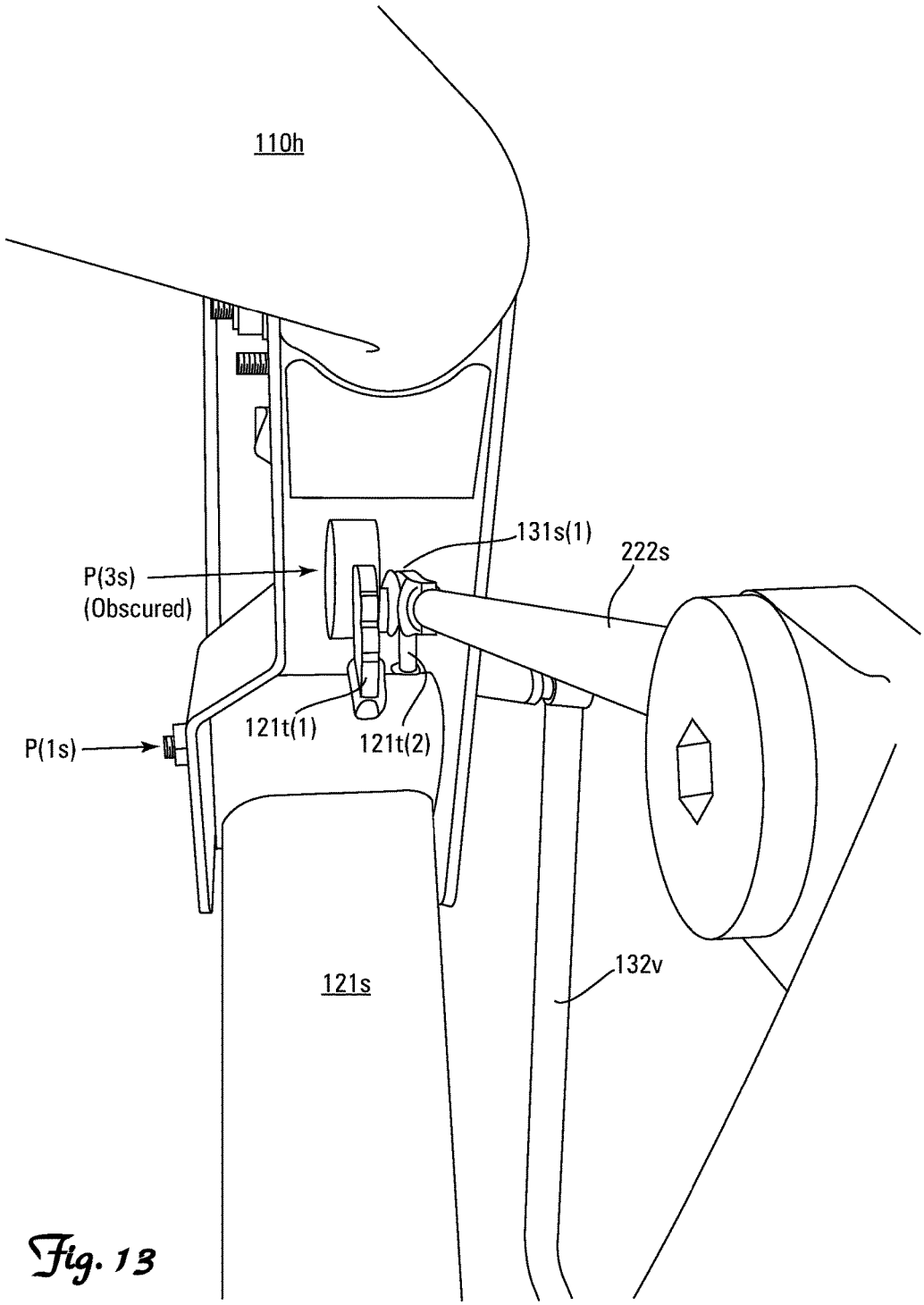
FIG. 13 is a still further enlarged, front view of the left-side pivot-manifold area of the invention depicted in FIG. 7.
Figure 14:
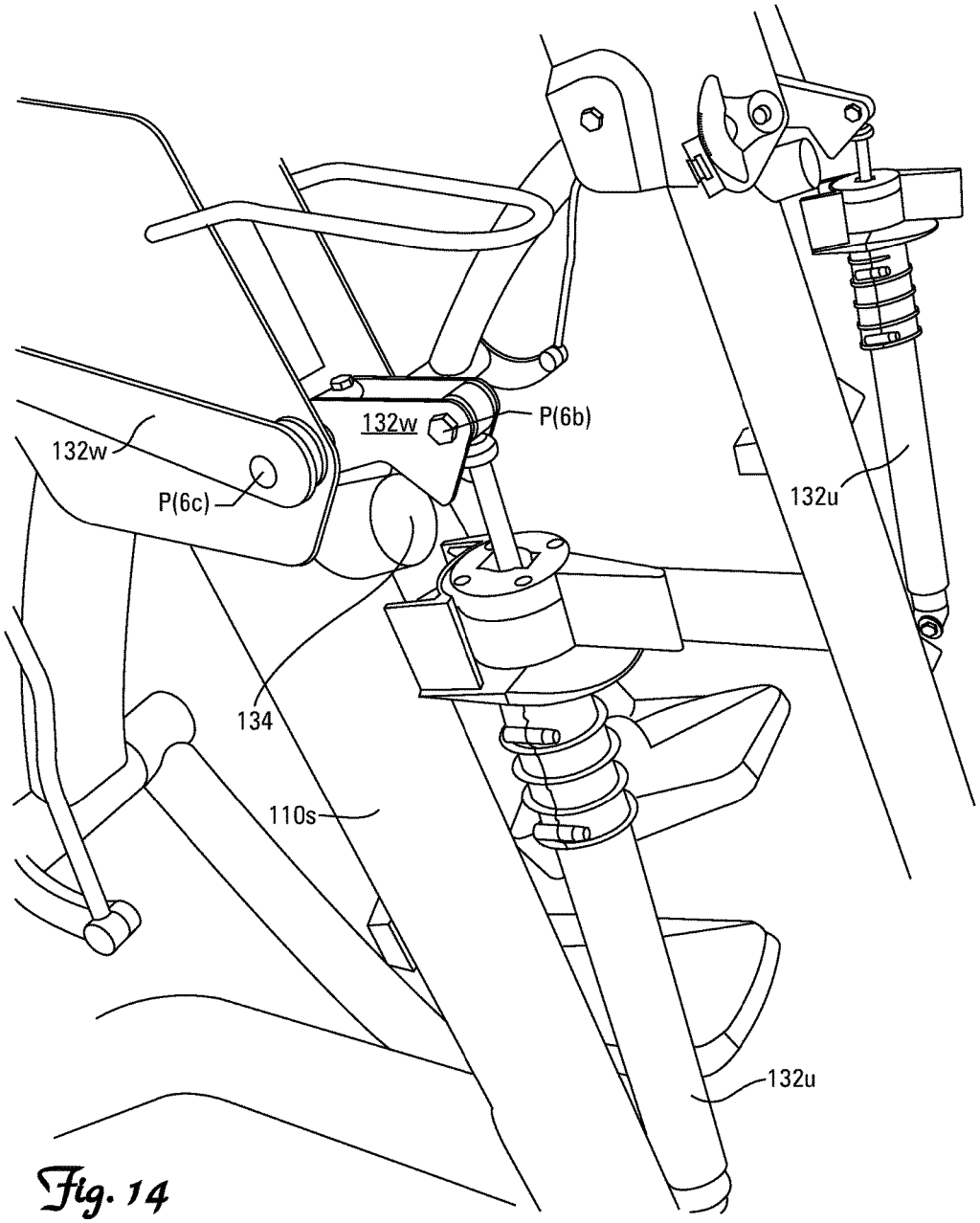
FIG. 14 is a close-up, rear isometric view of the adjustable biased damping components of the invention depicted in FIG. 7.
Figure 15:
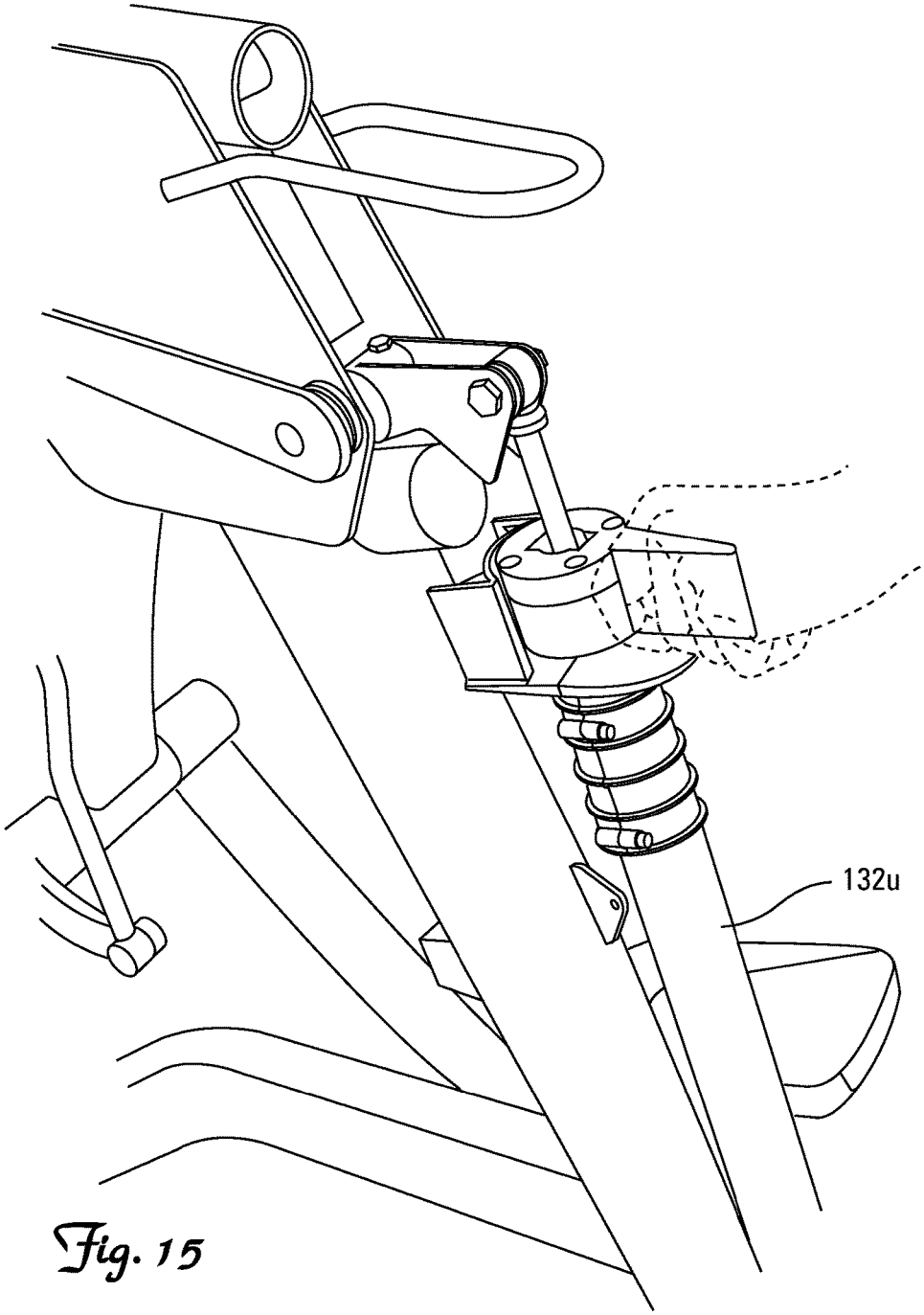
FIG. 15 depicts the adjustable biasing damping components of the invention depicted in FIG. 14 with the left-side biased damping component undergoing manual adjustment.
Figure 16:
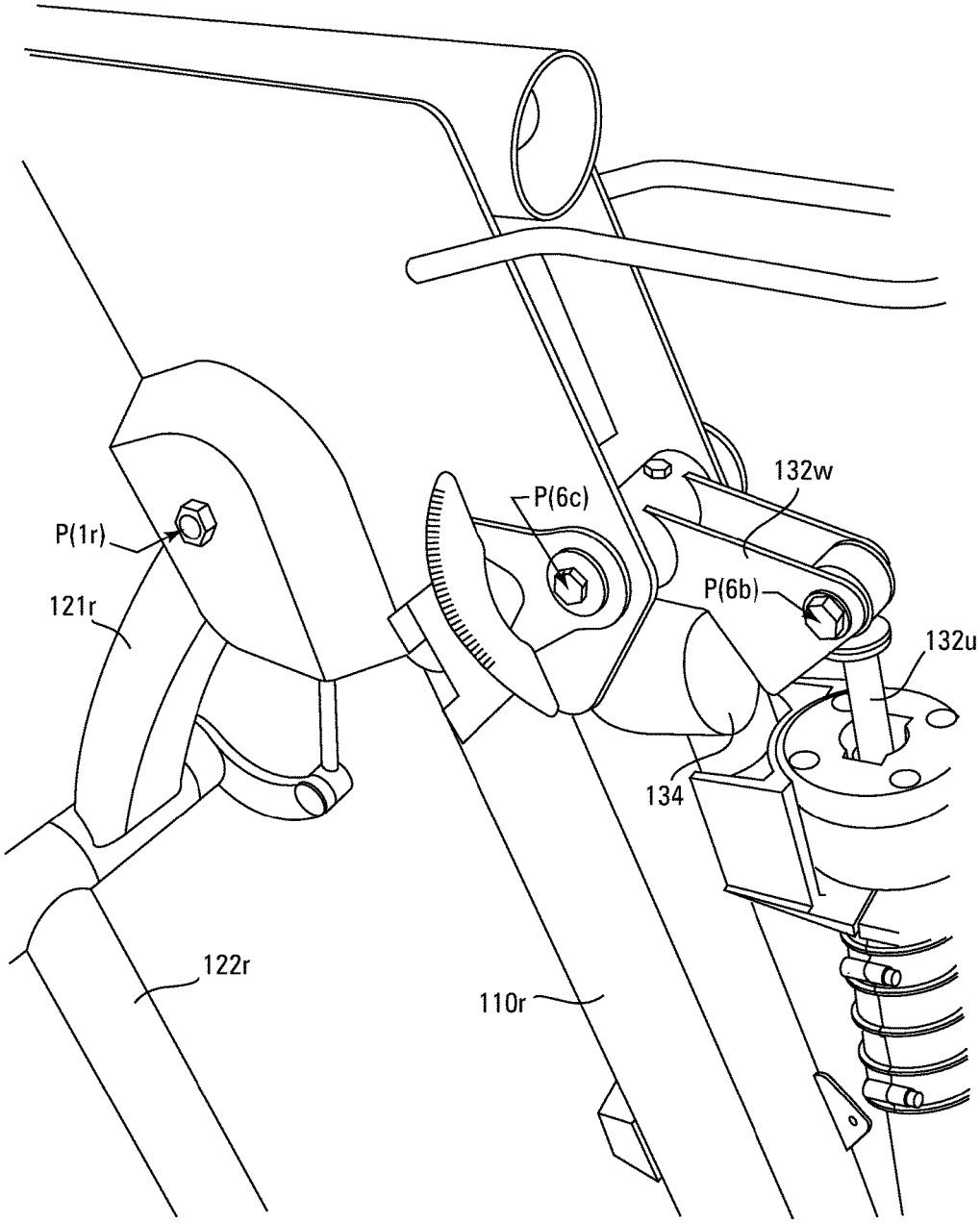
FIG. 16 is a still further enlarged internal rear isometric view of the interface between the right-side pivot-manifold area and the adjustable biased damping component of the invention depicted in FIG. 14.
Figure 17:
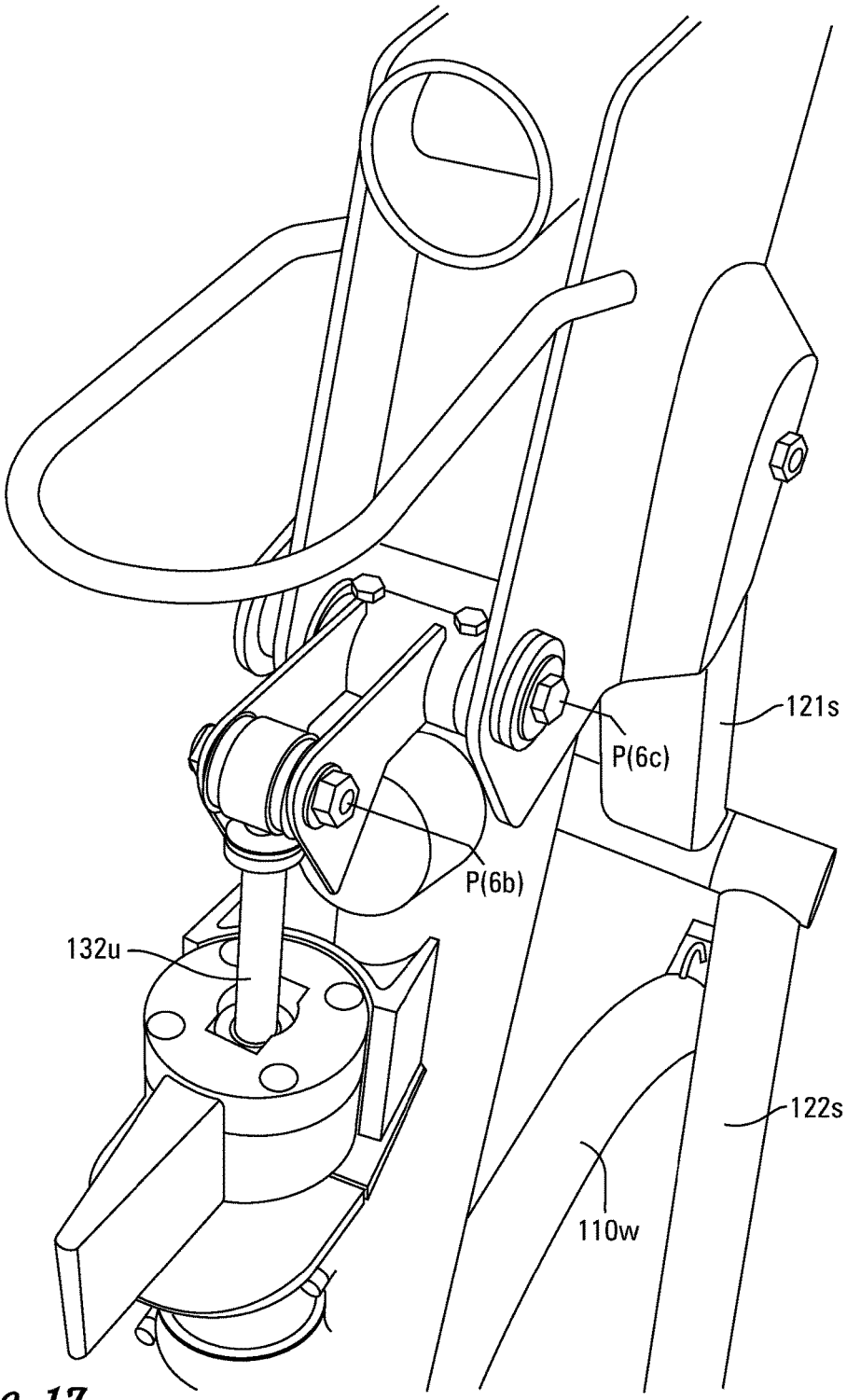
FIG. 17 is a still further enlarged internal rear isometric view of the interface between the left-side pivot-manifold area and the adjustable biased damping component of the invention depicted in FIG. 14.
Figure 18:
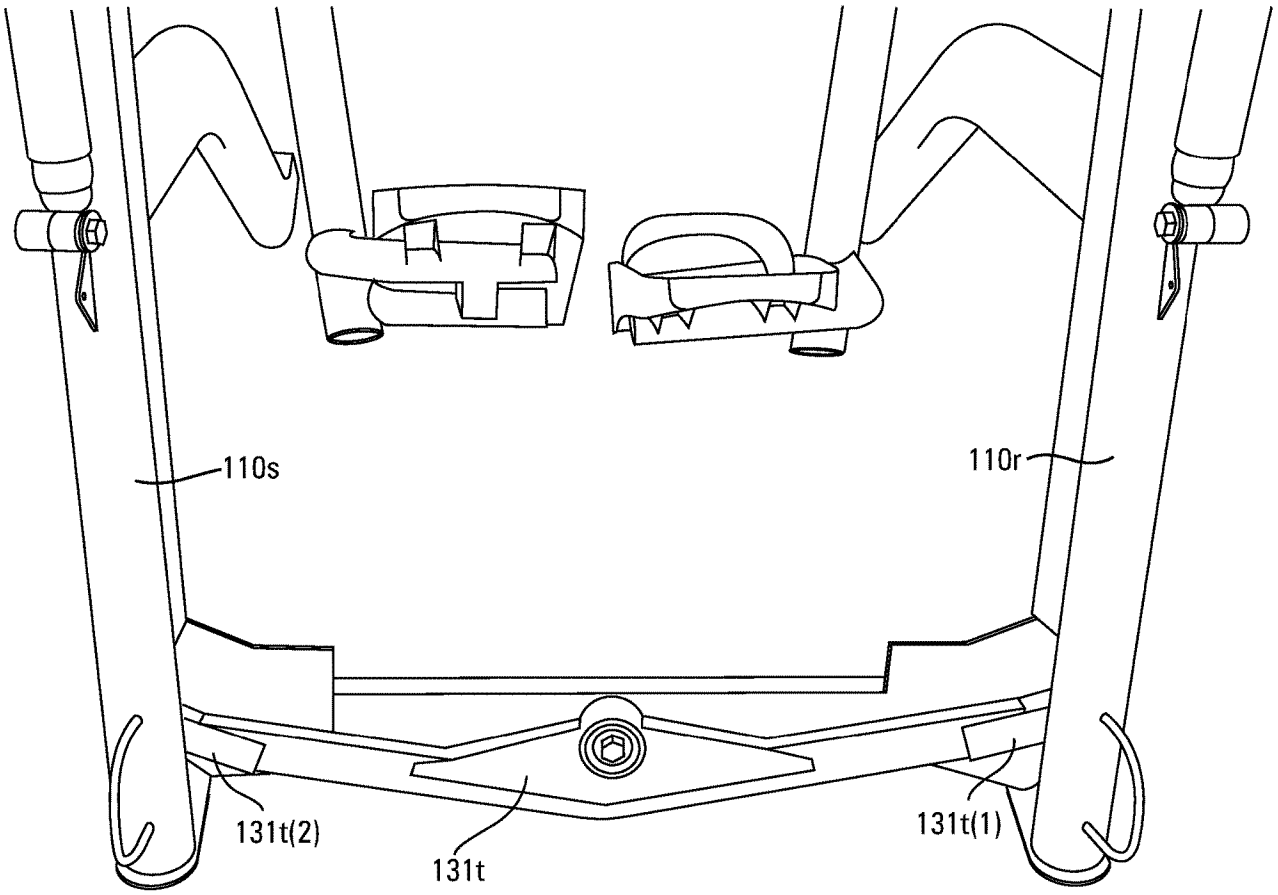
FIG. 18 is a close-up rear isometric view of the transfer bar component of the invention depicted in FIG. 7.
Figure 19:
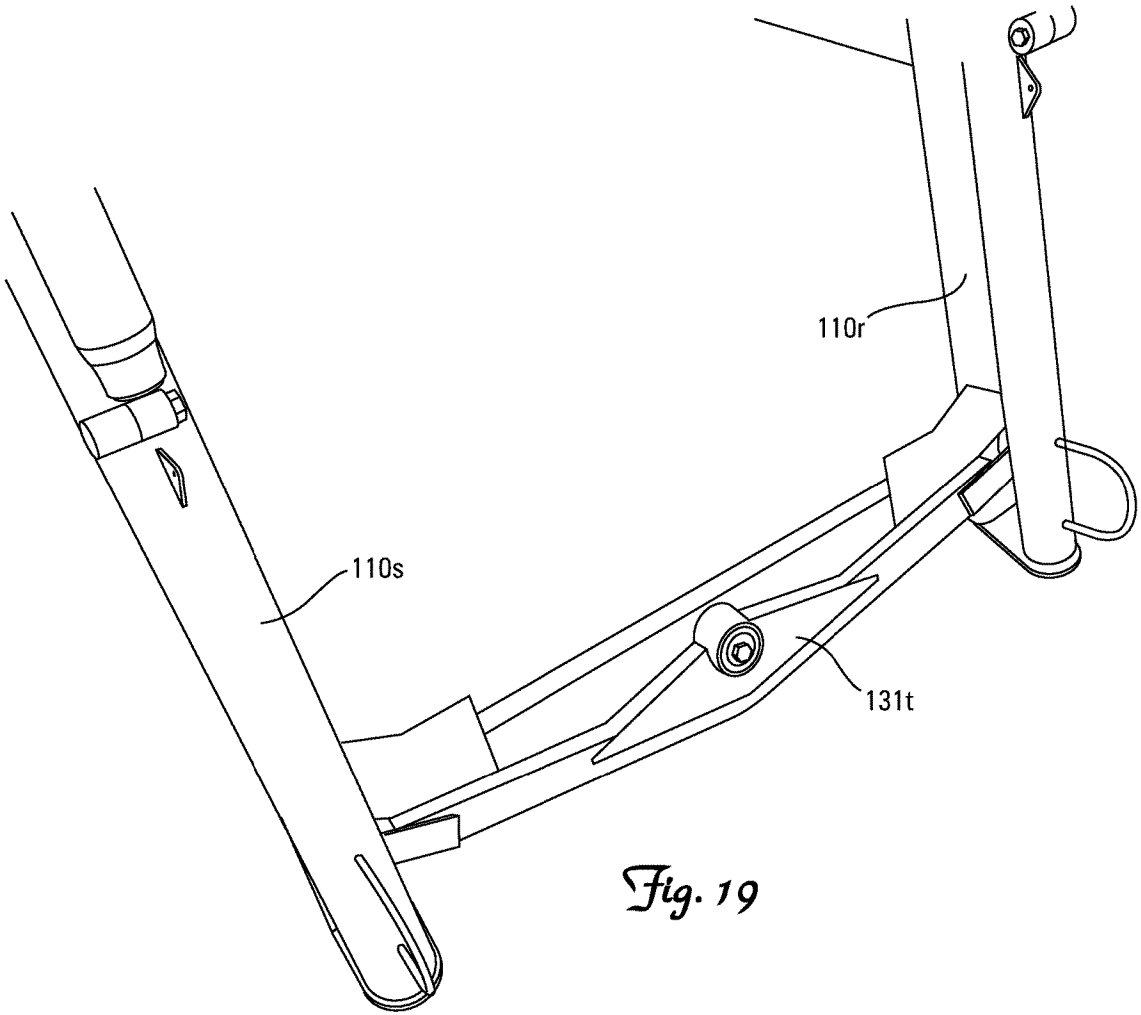
FIG. 19 is another enlarged rear isometric view of the transfer bar component of the invention depicted in FIG. 7.
Figure 20:
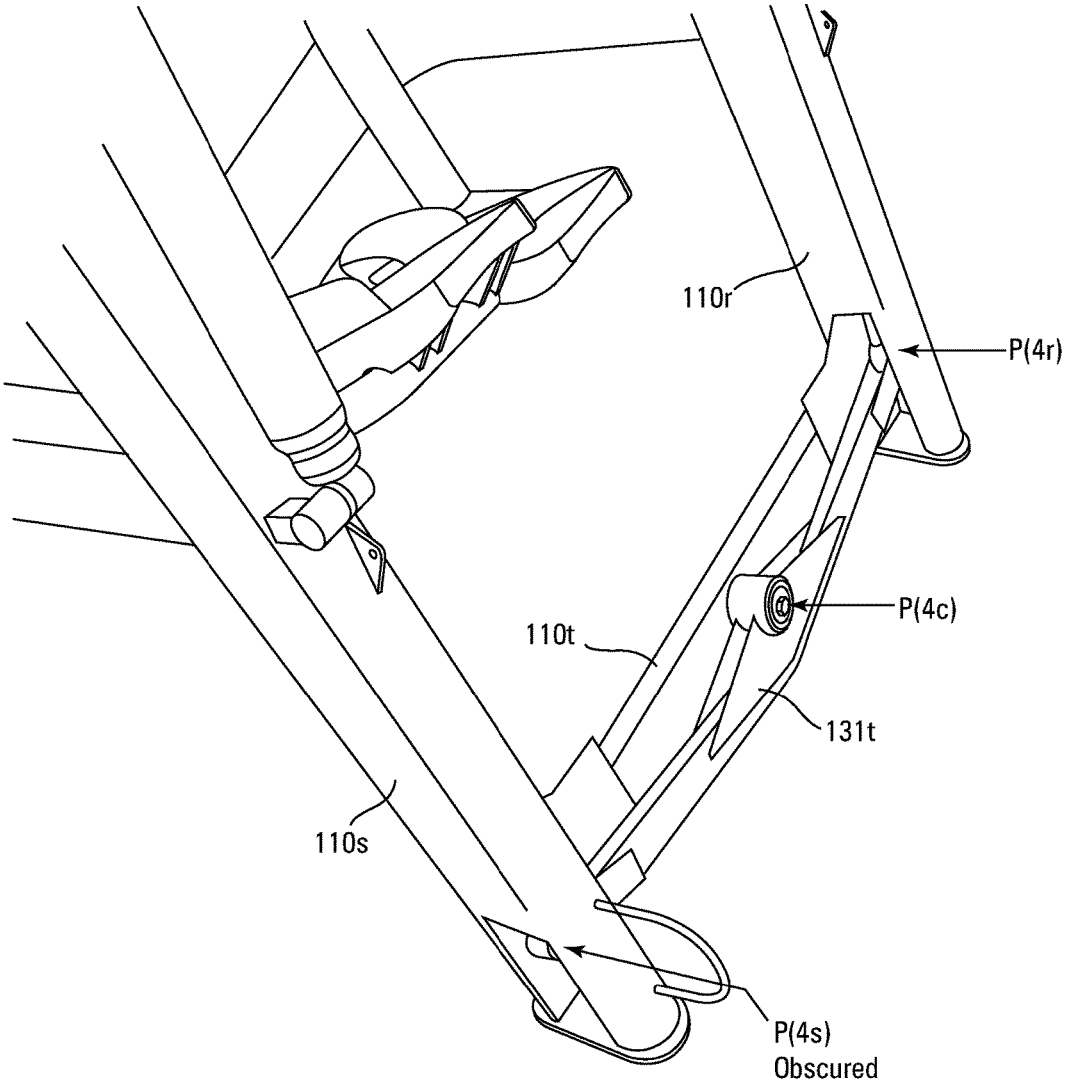
FIG. 20 is yet another enlarged rear isometric view of the transfer bar component of the invention depicted in FIG. 7.
Figure 21:
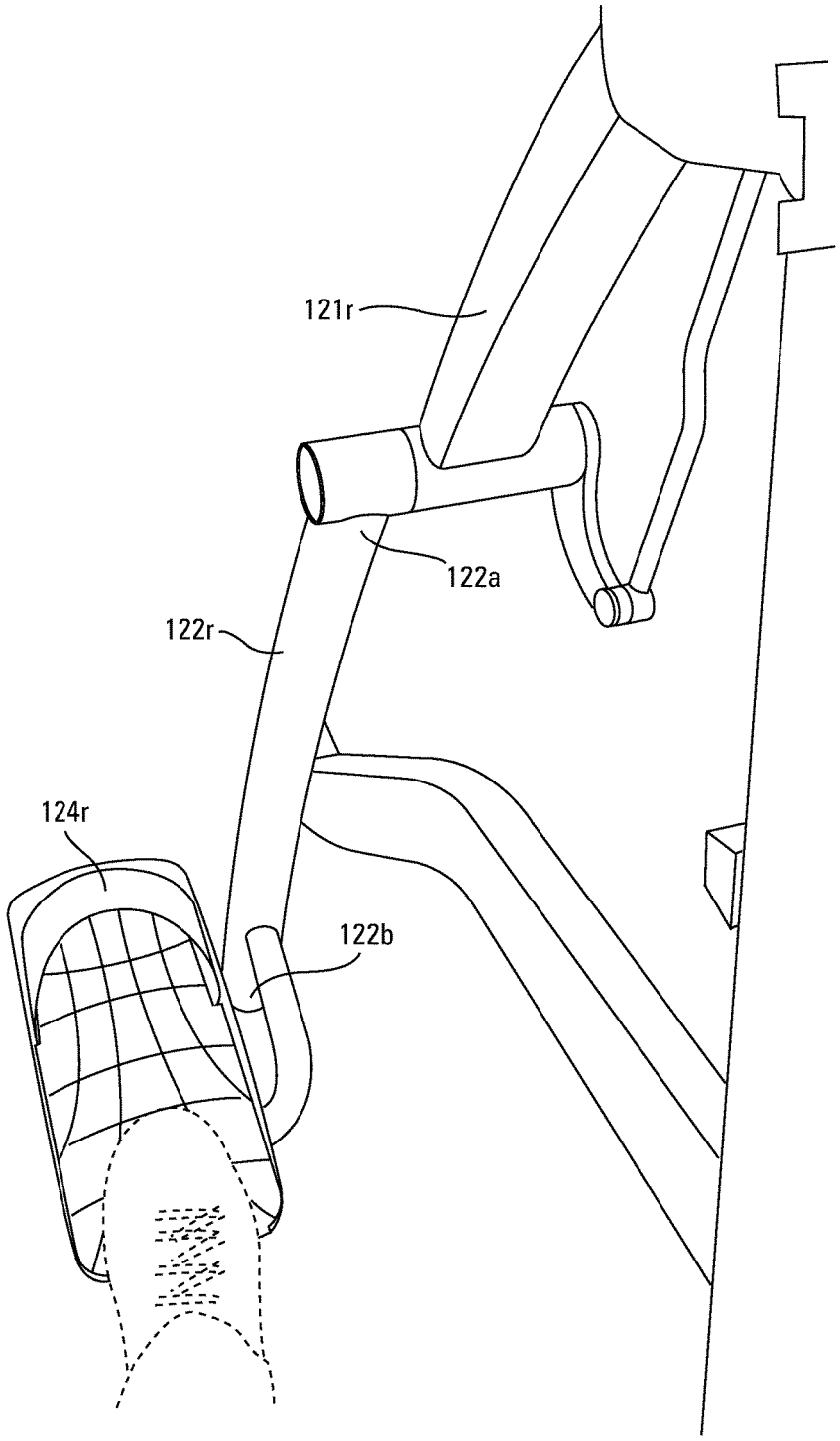
FIG. 21 is a close-up, internal rear isometric view of the right calf member of the invention depicted in FIG. 7 including the right foot support.
Figure 22:
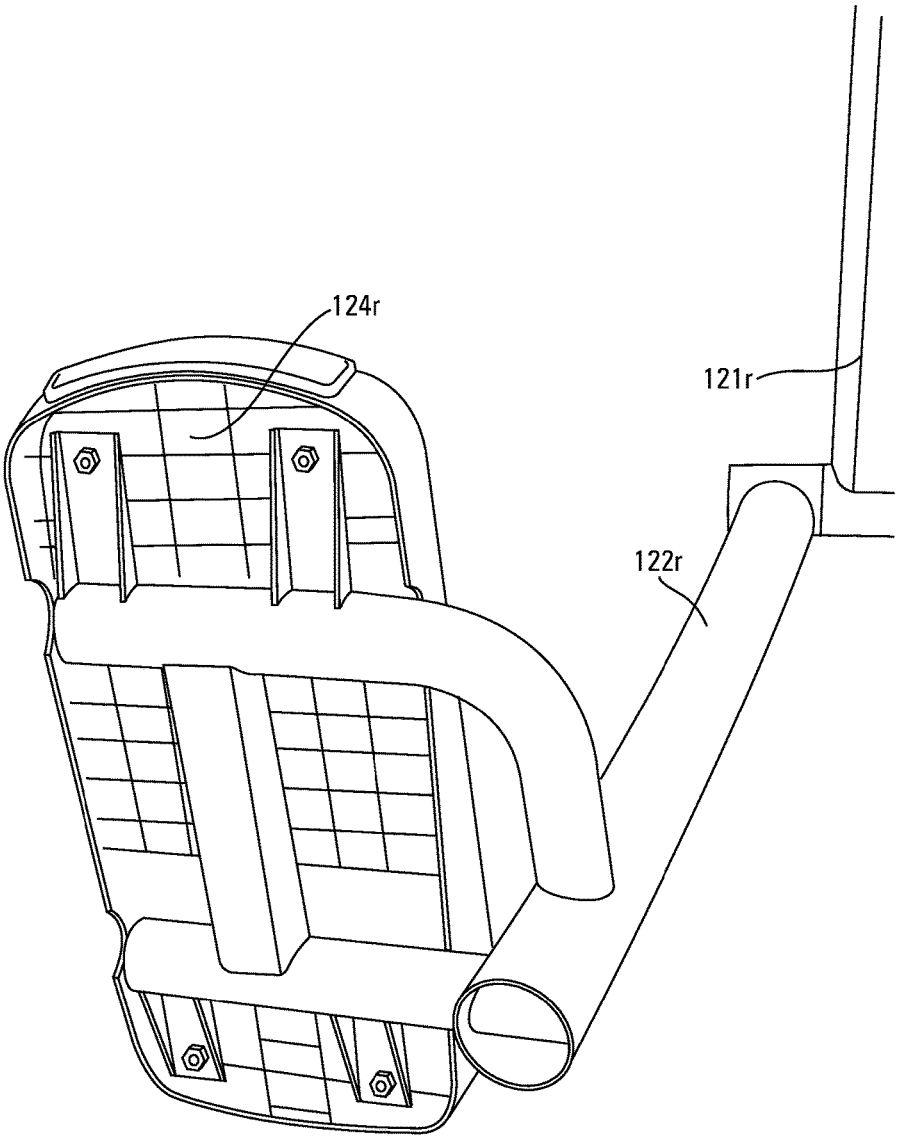
FIG. 22 is a close-up isometric view of the bottom of the right foot support depicted in FIG. 7.
Figure 23:
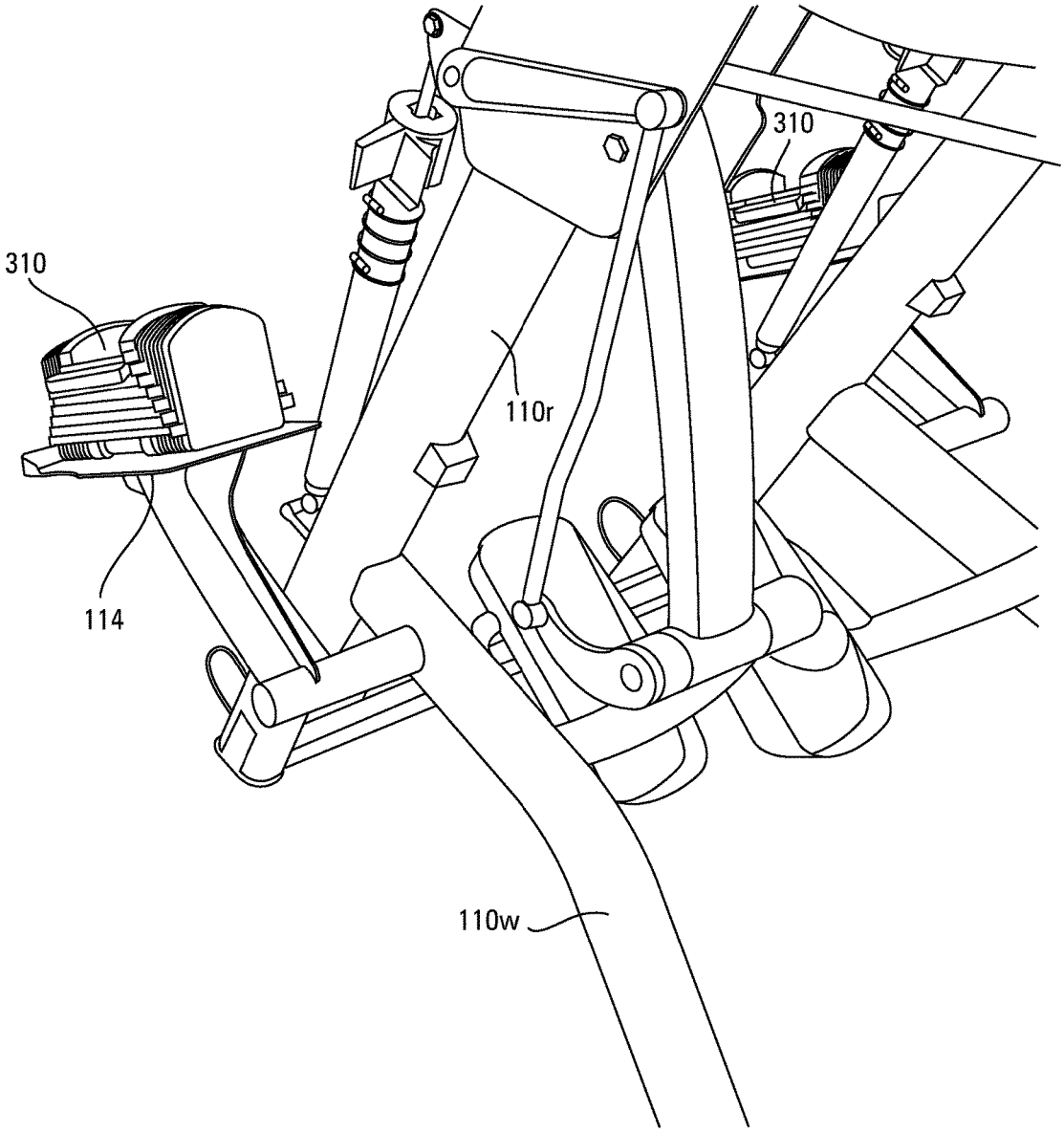
FIG. 23 is a front isometric view of the invention depicted in FIG. 7 equipped with an optional pair of selectorized dumbbells supported on optional shelves attached to the frame of the machine.
Figure 24:
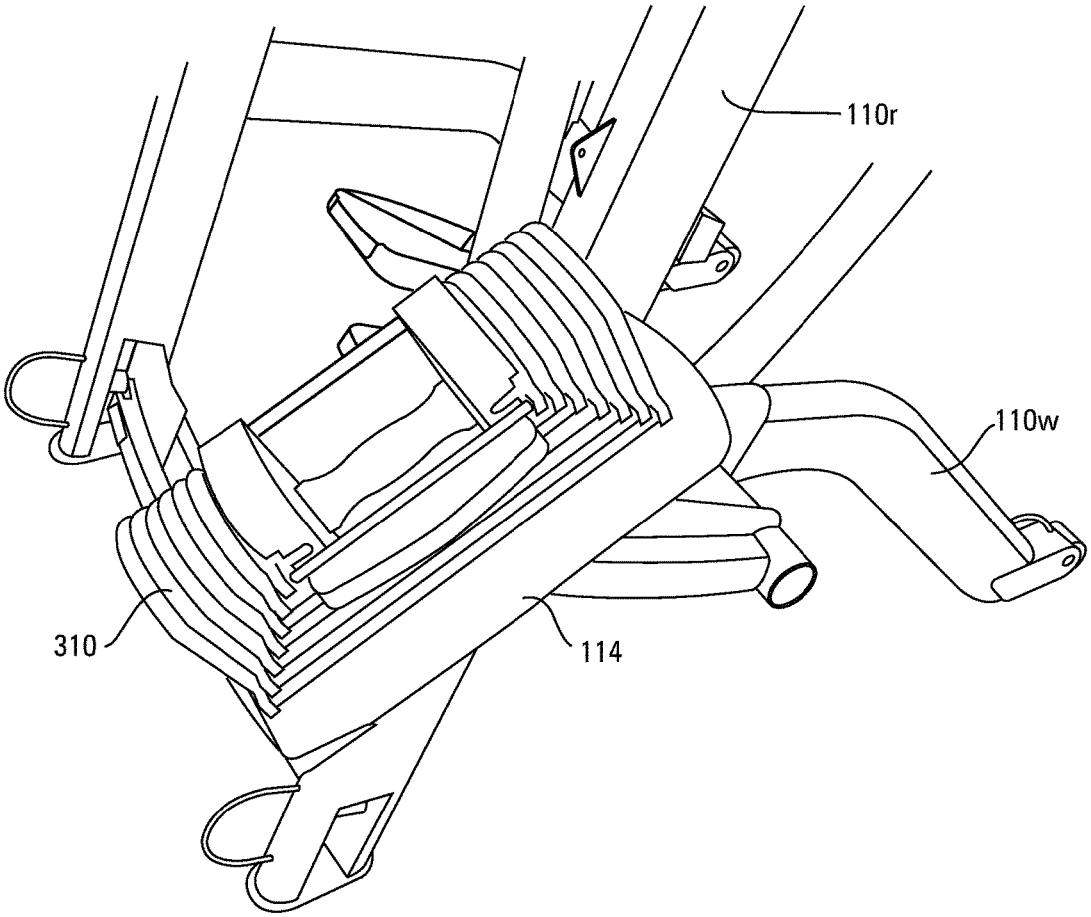
FIG. 24 is a close-up rear isometric view of the right selectorized dumbbell supported on the right shelf depicted in FIG. 23.
Figure 25:
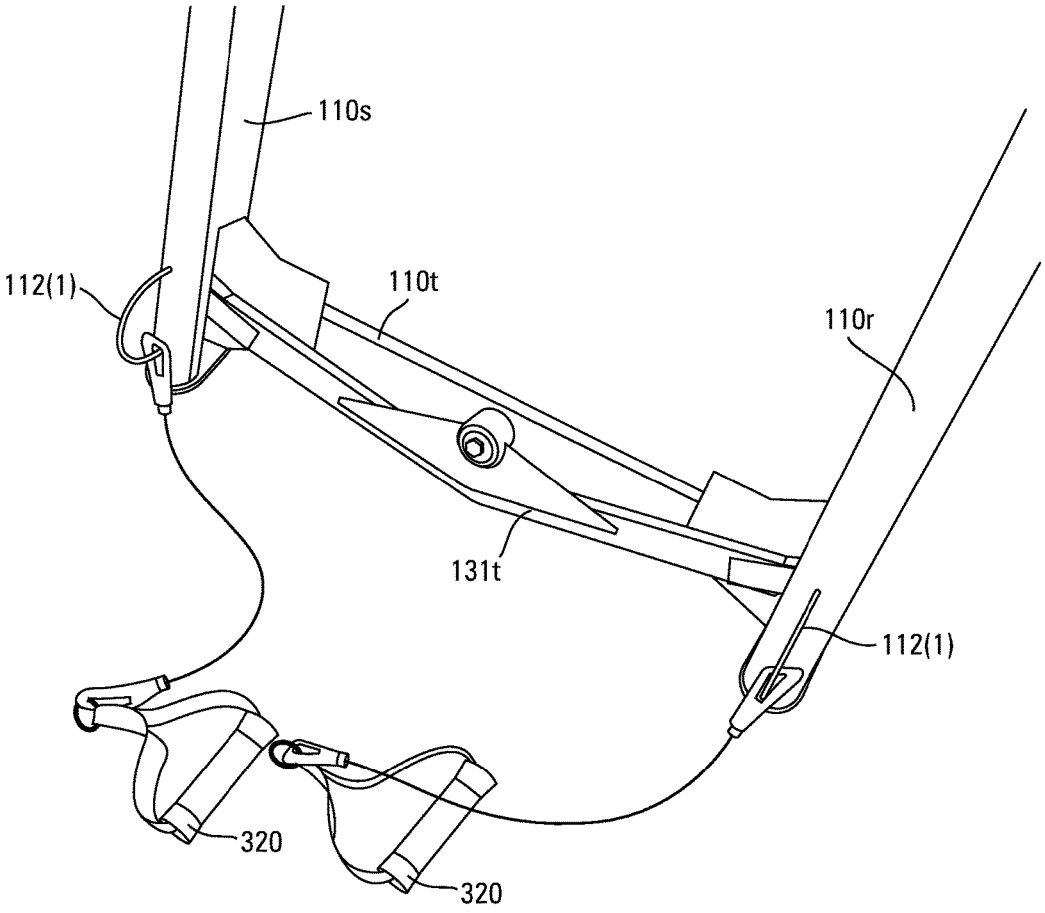
FIG. 25 is a rear isometric view of the base portion of the invention depicted in FIG. 7 equipped with an optional pair of elastic band exercise handles, each attached to a D-ring on the lower end of the right and left stanchions of the frame.
Figure 26:
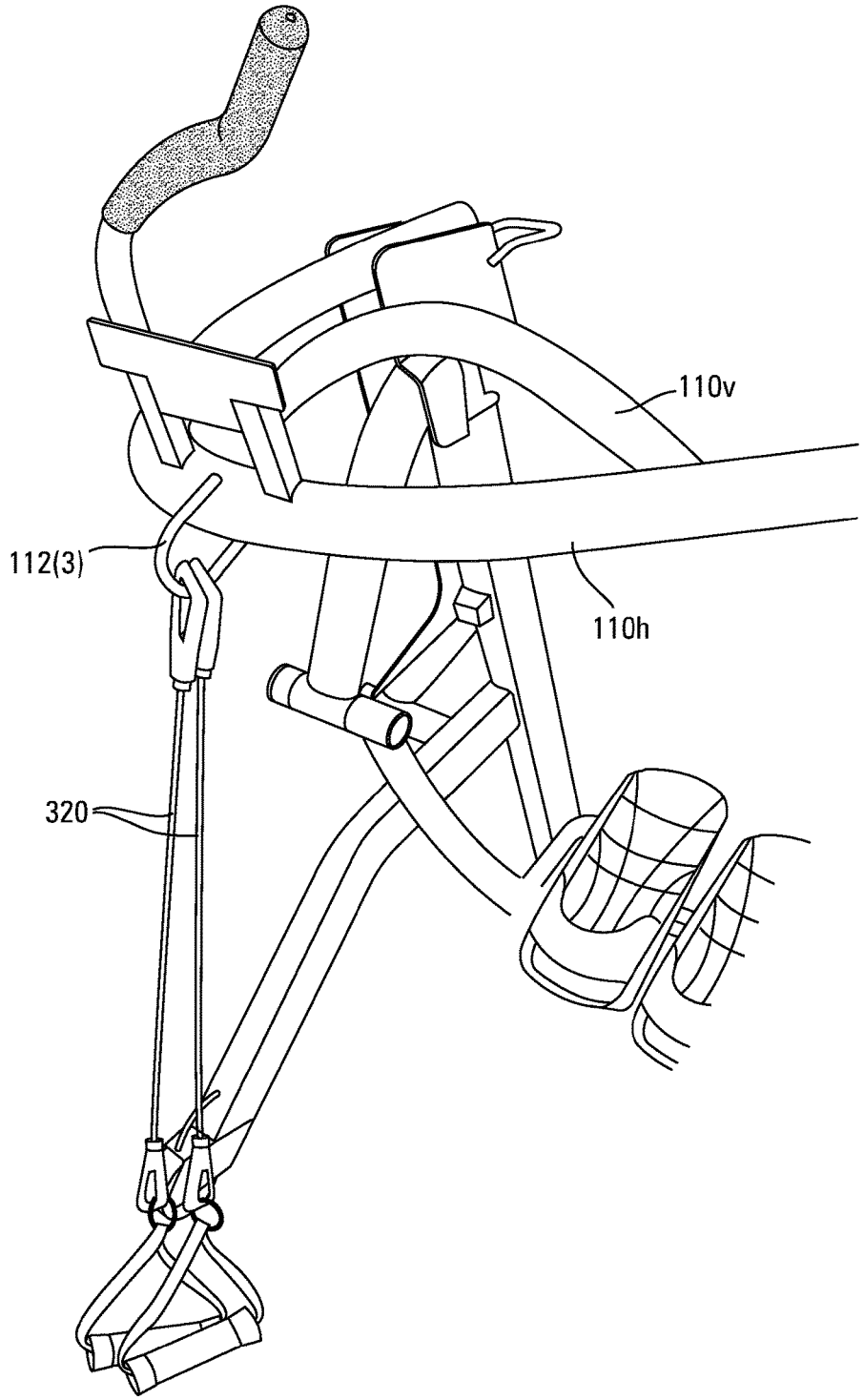
FIG. 26 is a close-up front isometric view of the upper portion of the invention depicted in FIG. 7 equipped with an optional pair of elastic band exercise handles, both attached to a single laterally-centered D-ring on the handrail.
Figure 27:
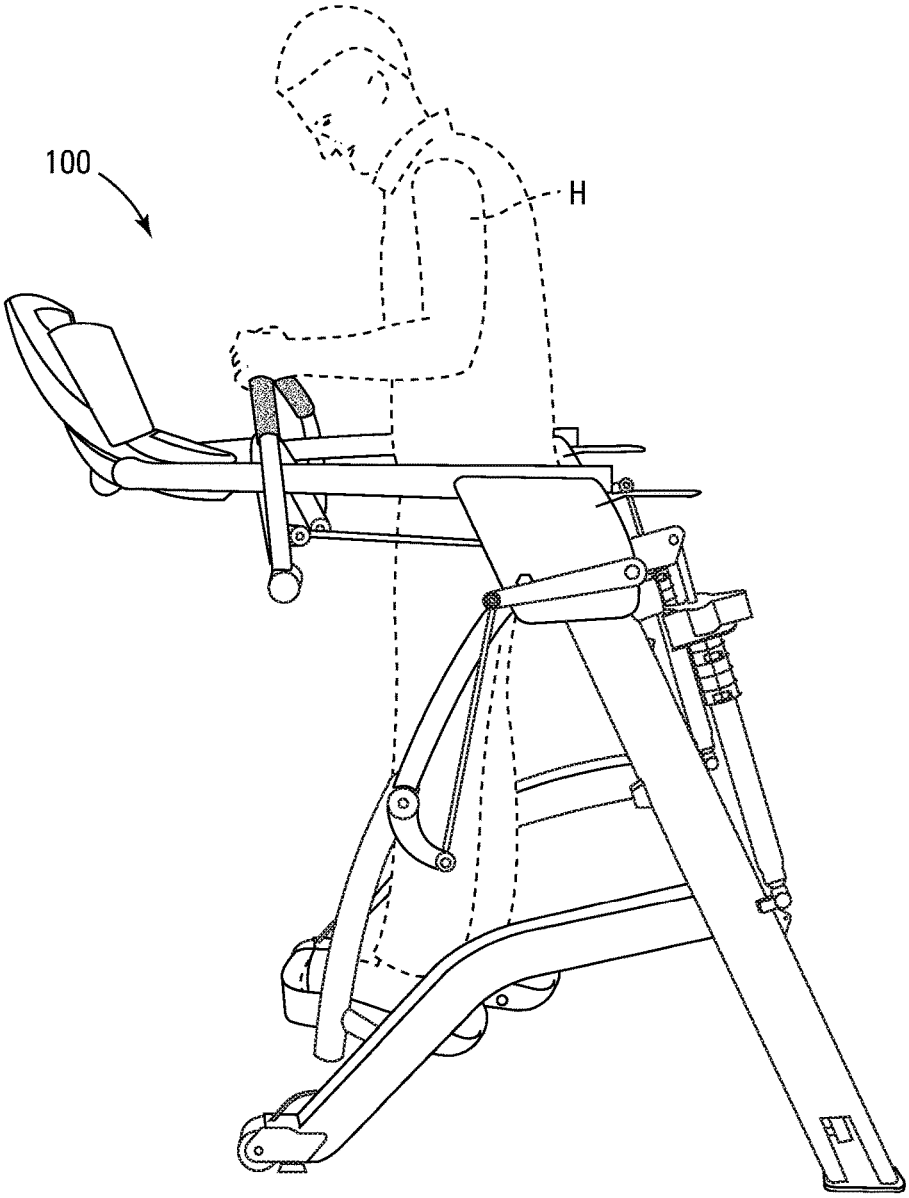
FIG. 27 is a left-side view of the invention depicted in FIG. 7 with an orthostatic forward facing suited user supported upon the foot supports with the foot supports substantially horizontally and almost perfectly vertically aligned.
Figure 28:
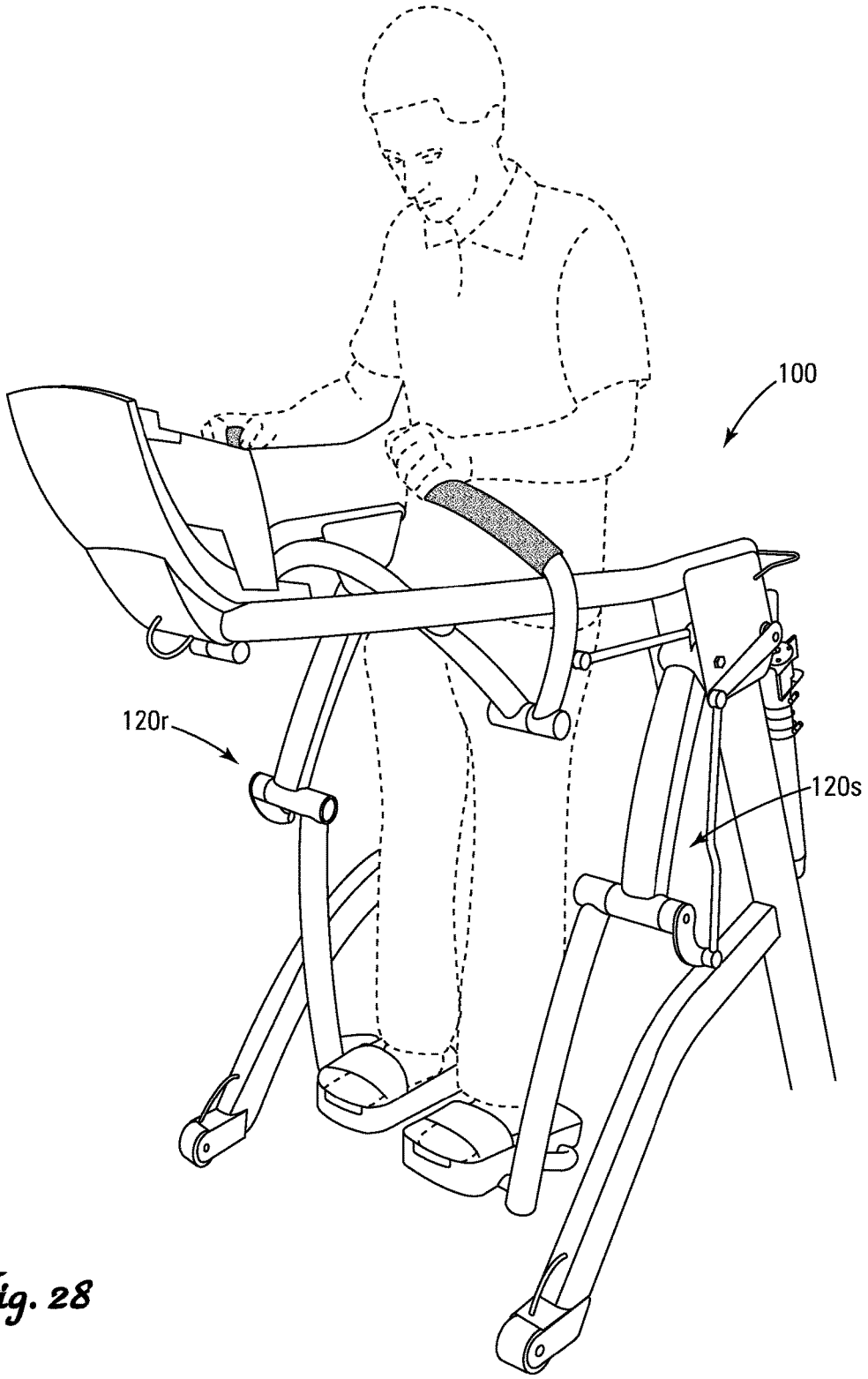
FIG. 28 is a front isometric view of the invention depicted in FIG. 7 with an orthostatic forward facing suited user supported upon the foot supports with the foot supports horizontally and vertically aligned.
Figure 29:
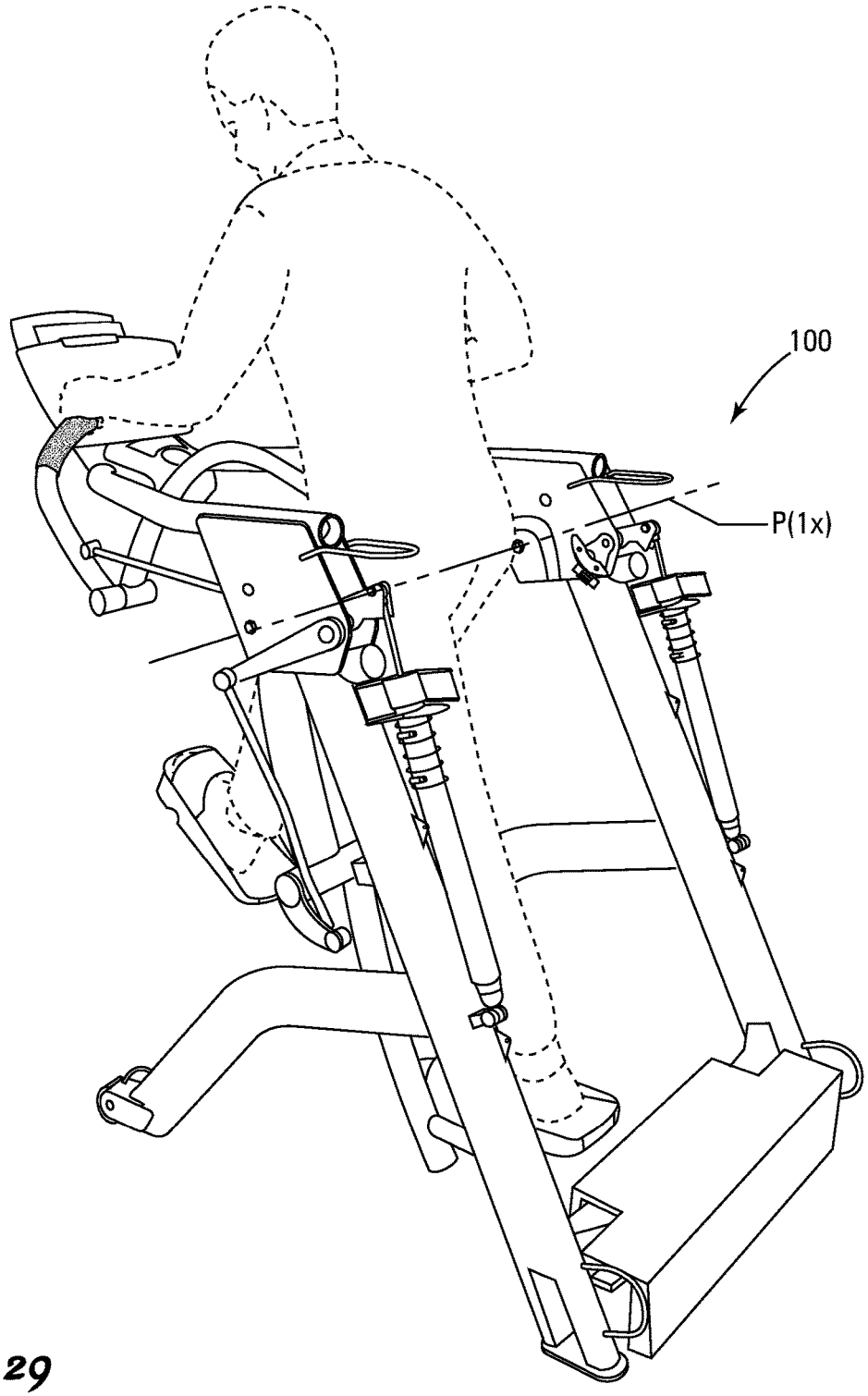
FIG. 29 is a rear isometric view of the invention depicted in FIG. 7 with a forward facing suited user walking on the exercise machine.
Figure 30:
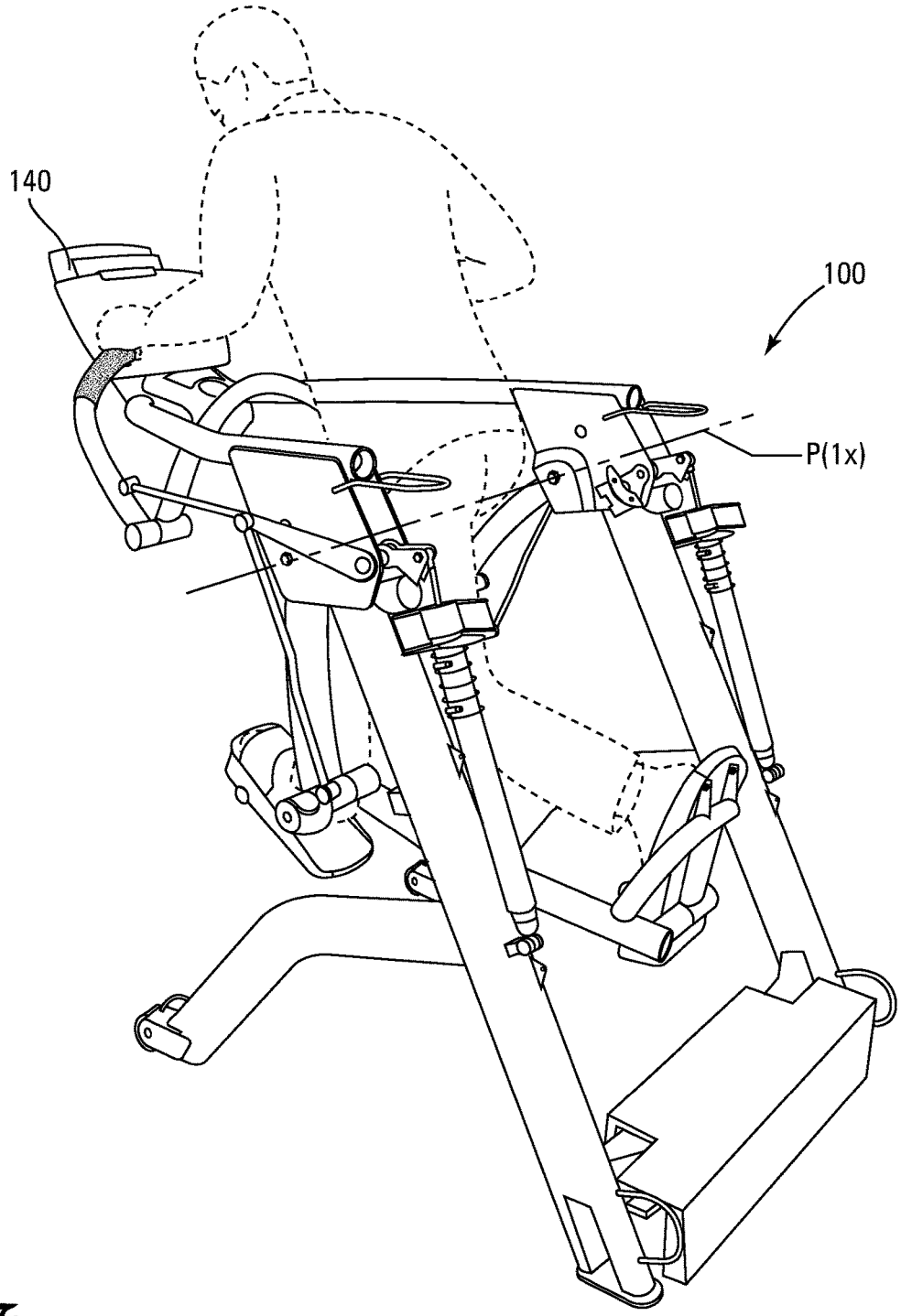
FIG. 30 is a rear isometric view of the invention depicted in FIG. 7 with a forward facing suited user running on the exercise machine.
Figure 31:
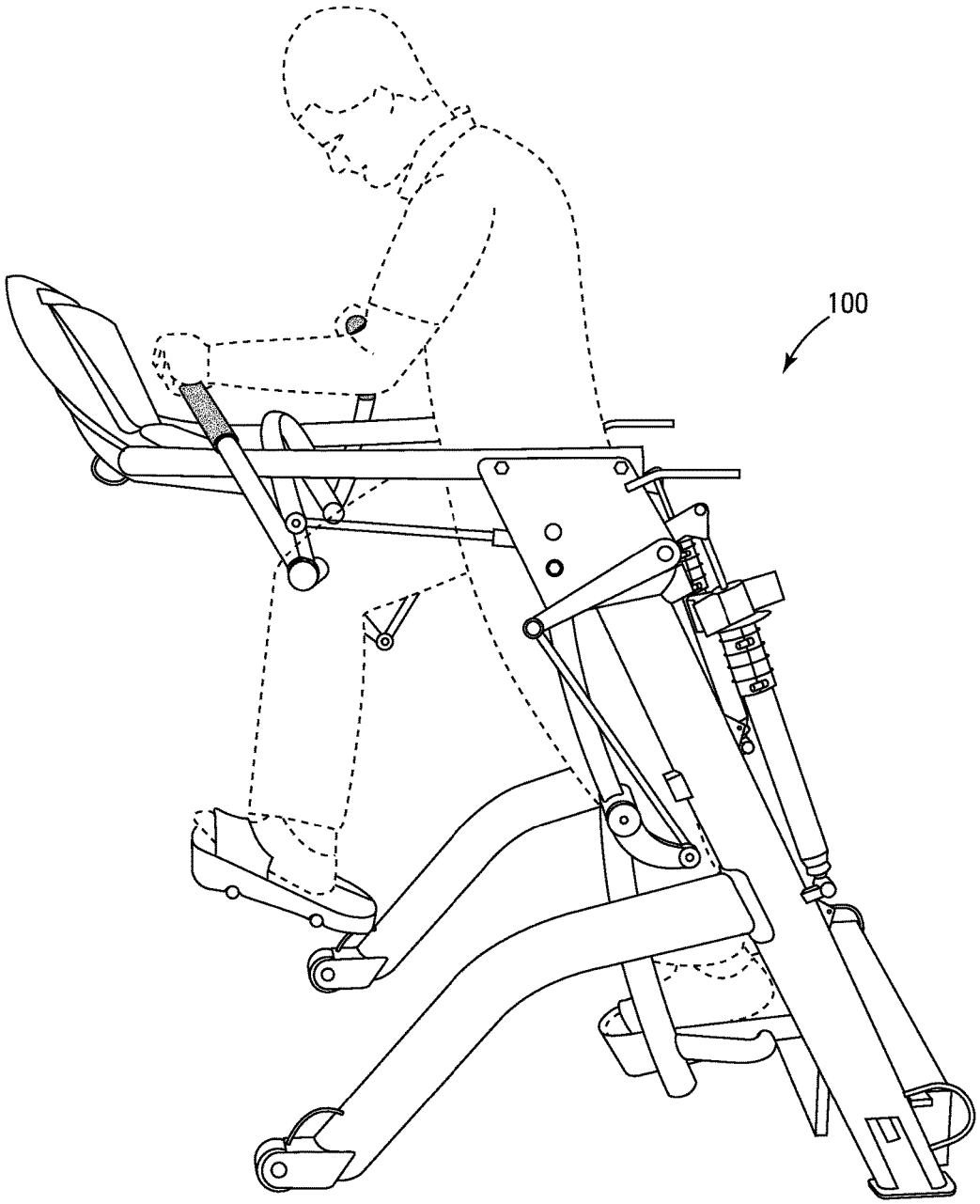
FIG. 31 is a left-side view of the invention depicted in FIG. 7 with a forward facing suited user running on the exercise machine.
Figure 32:
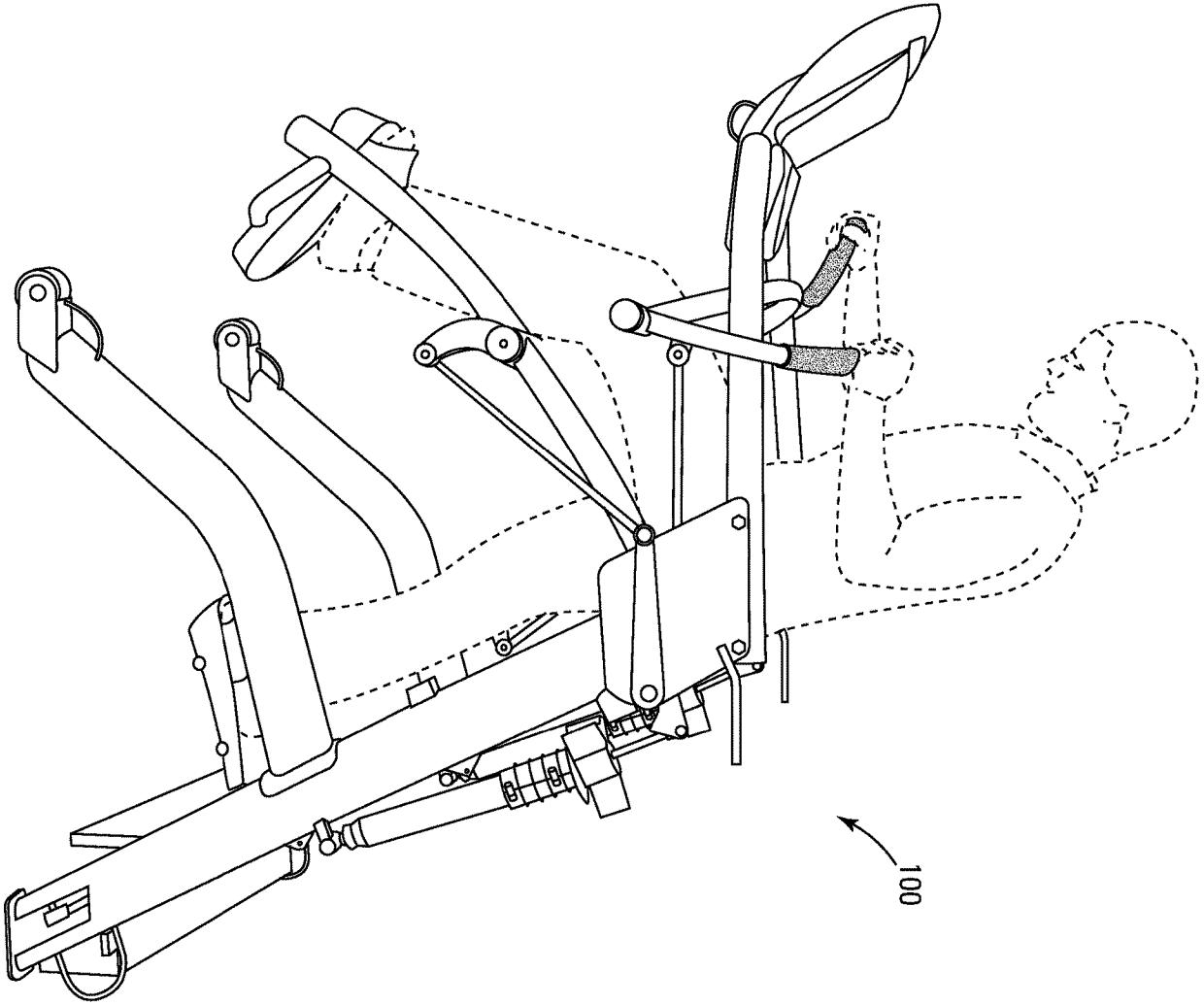
FIG. 32 is another left-side view of the invention depicted in FIG. 7 with a forward facing suited user running on the exercise machine.
Figure 33:
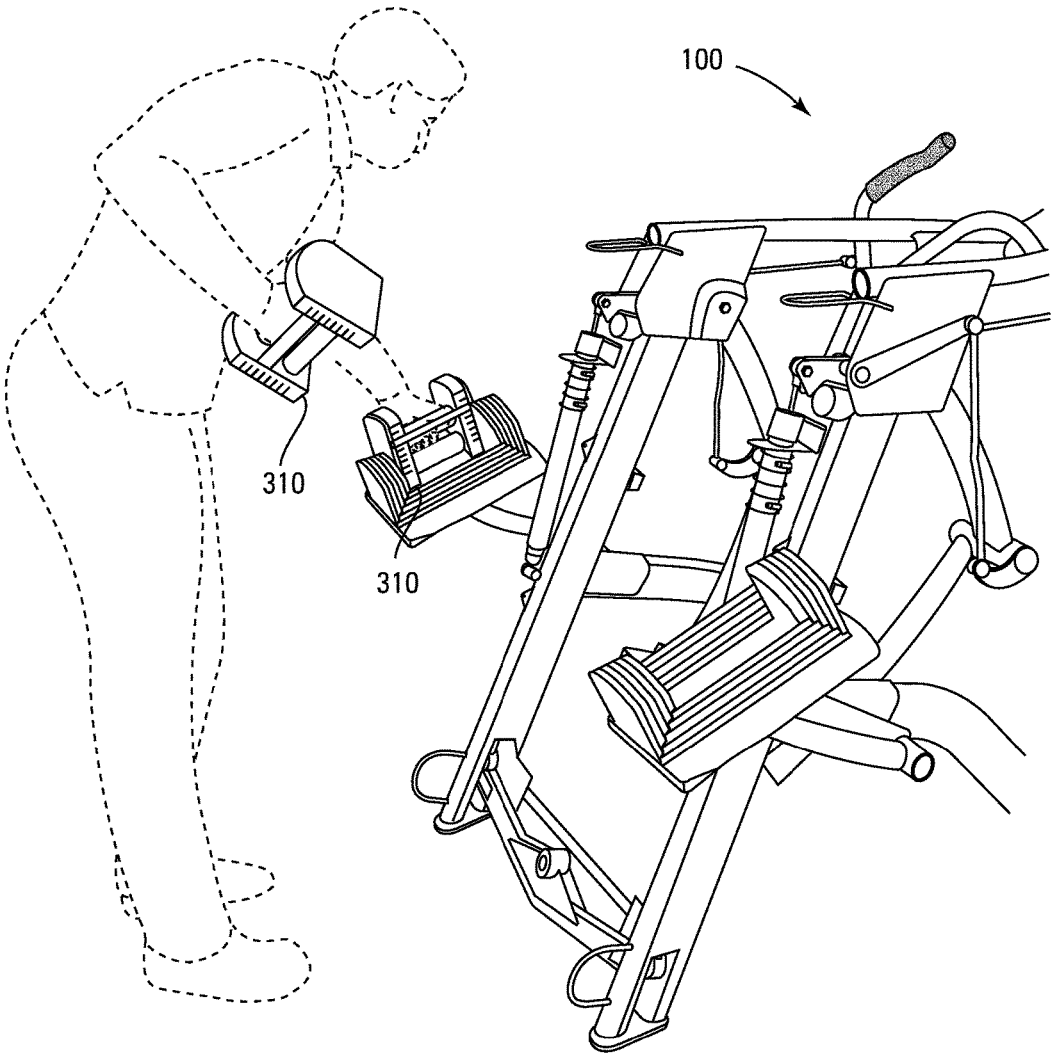
FIG. 33 is a rear view of the invention depicted in FIG. 23 with a suited user preparing to perform a strength training exercise using the selectorized dumbells.
Figure 34:
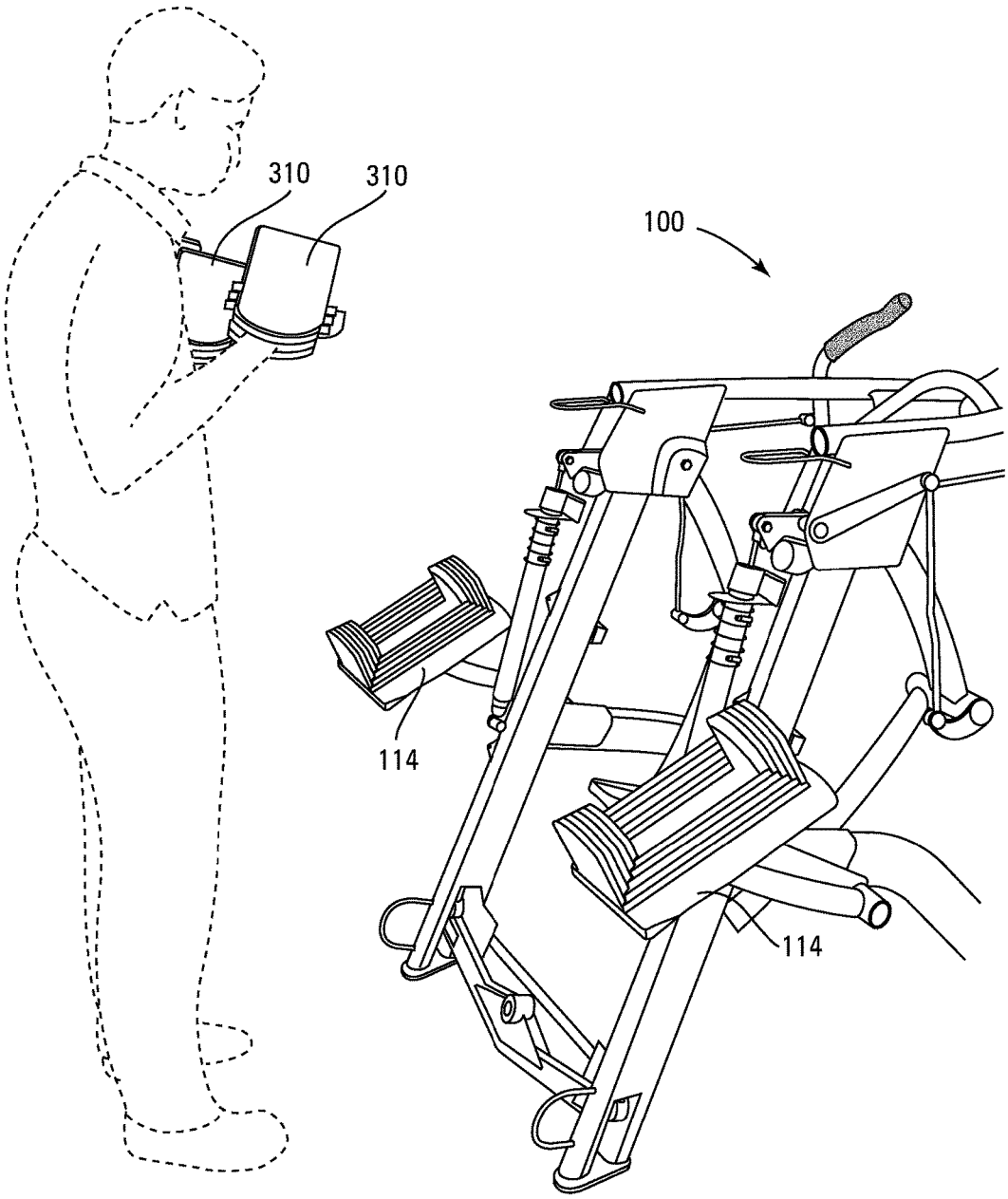
FIG. 34 is a rear view of the invention depicted in FIG. 23 with a suited user performing a strength training exercise using the selectorized dumbells.
Figure 35:
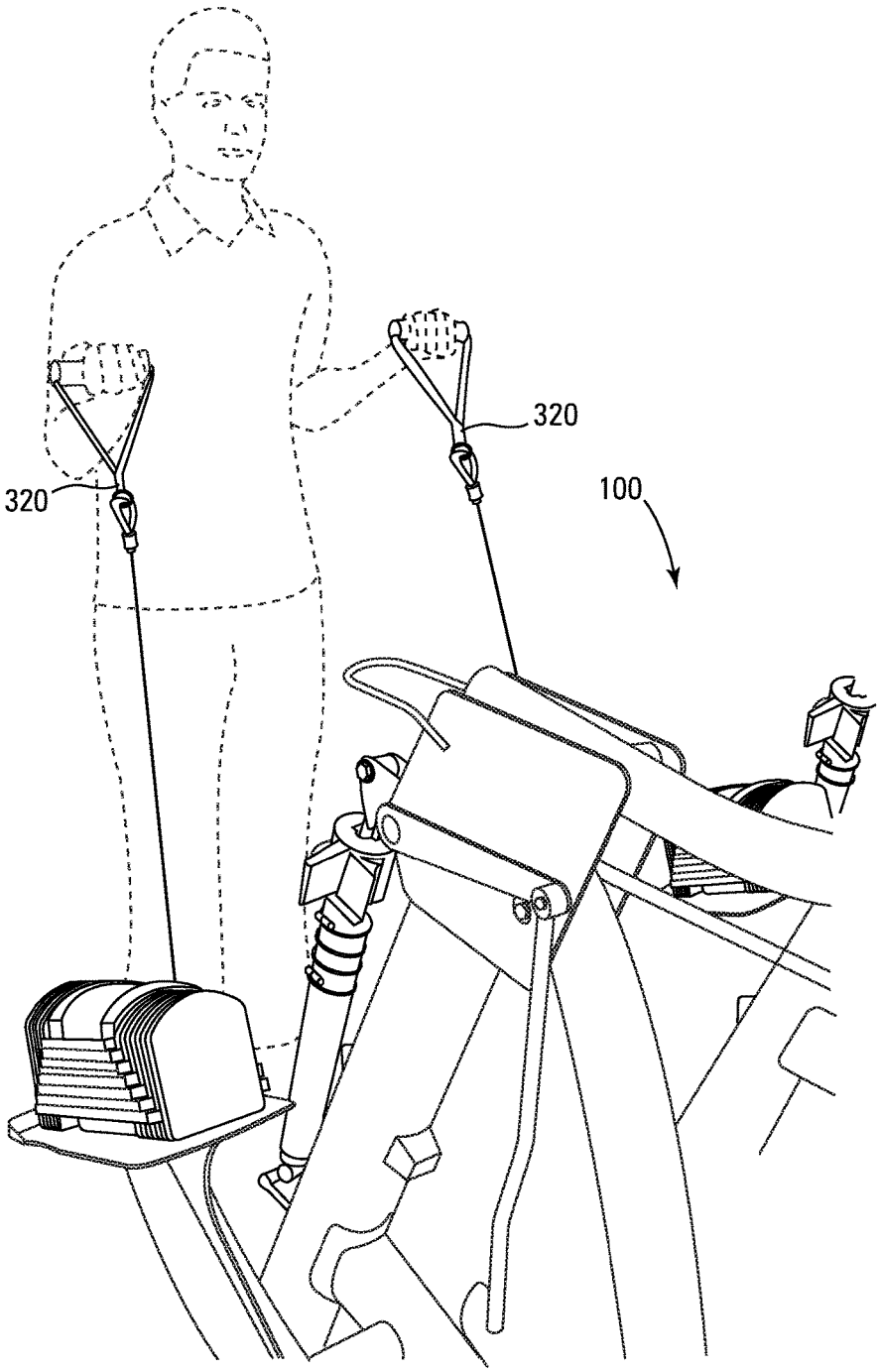
FIG. 35 is a front view of the invention depicted in FIG. 25 with a suited user performing a strength training exercise using the pair of elastic band exercise handles attached to the D-rings on the lower end of the right and left stanchions of the frame.
Figure 36:
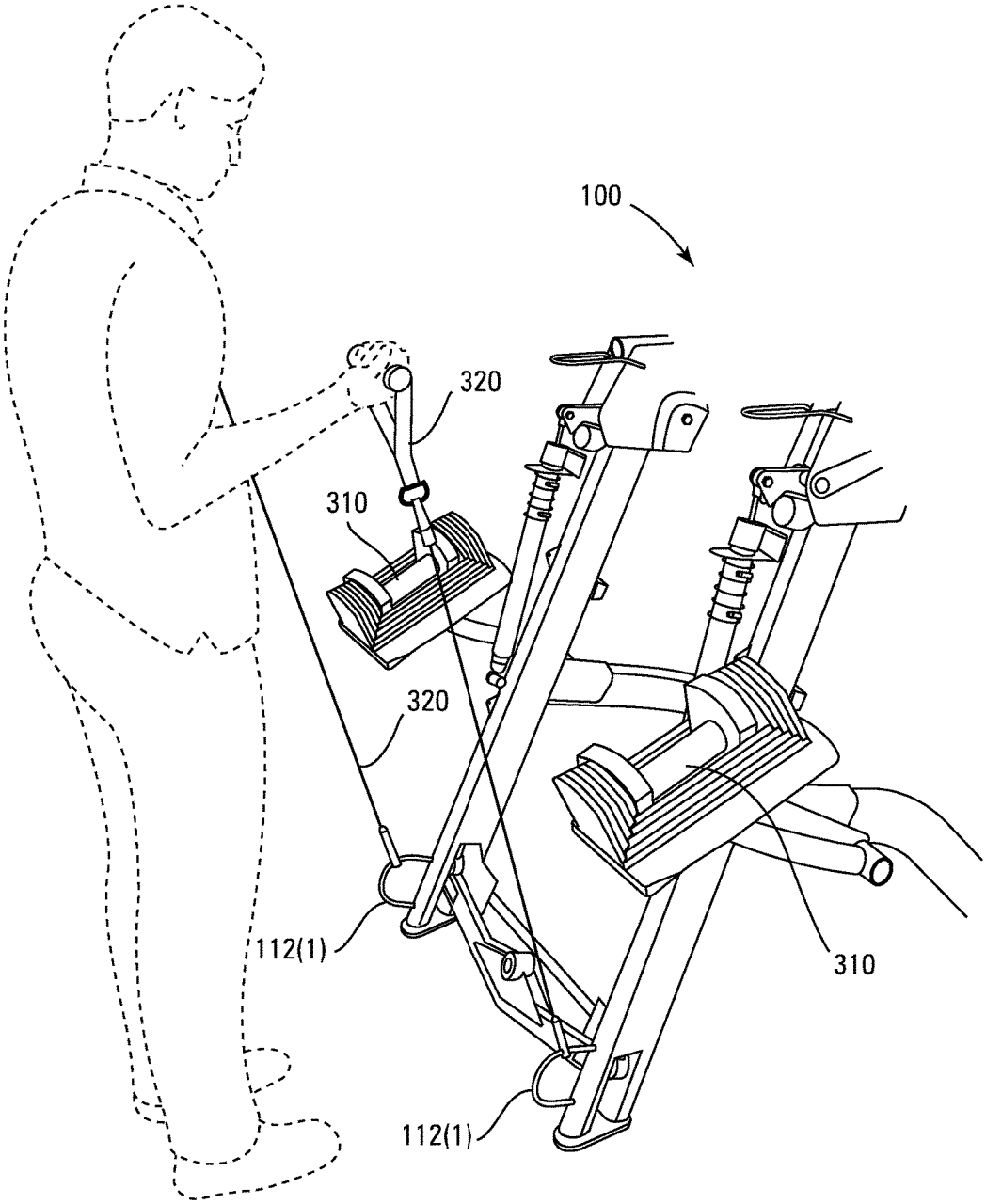
FIG. 36 is a rear view of the invention depicted in FIG. 25 with a suited user performing a strength training exercise using the pair of elastic band exercise handles attached to the D-rings on the lower end of the right and left stanchions of the frame.
Figure 37:
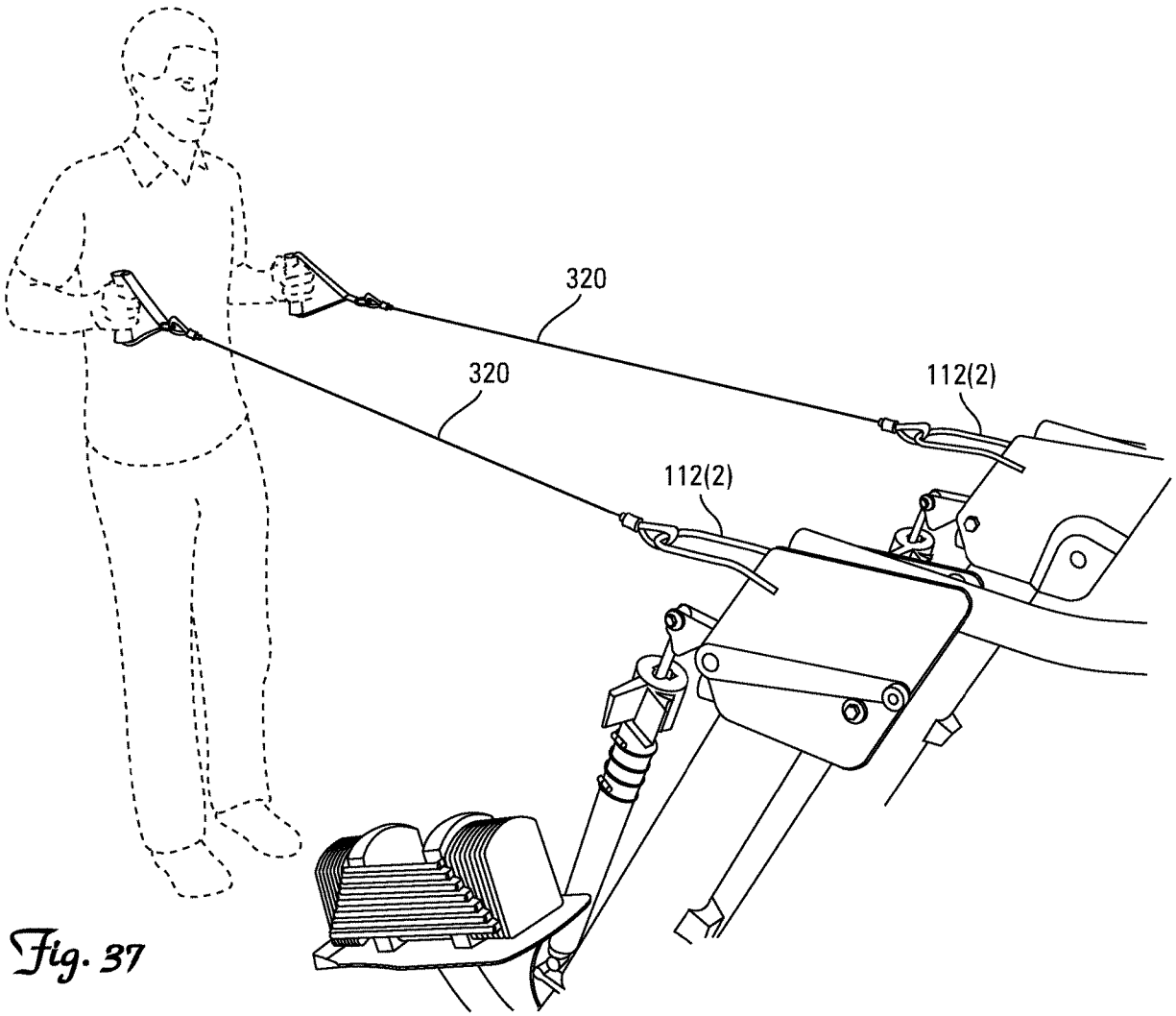
FIG. 37 is a front view of the invention depicted in FIG. 25 with a suited user performing a strength training exercise using the pair of elastic band exercise handles attached to the D-rings on the upper end of the right and left stanchions of the frame.
Figure 38:
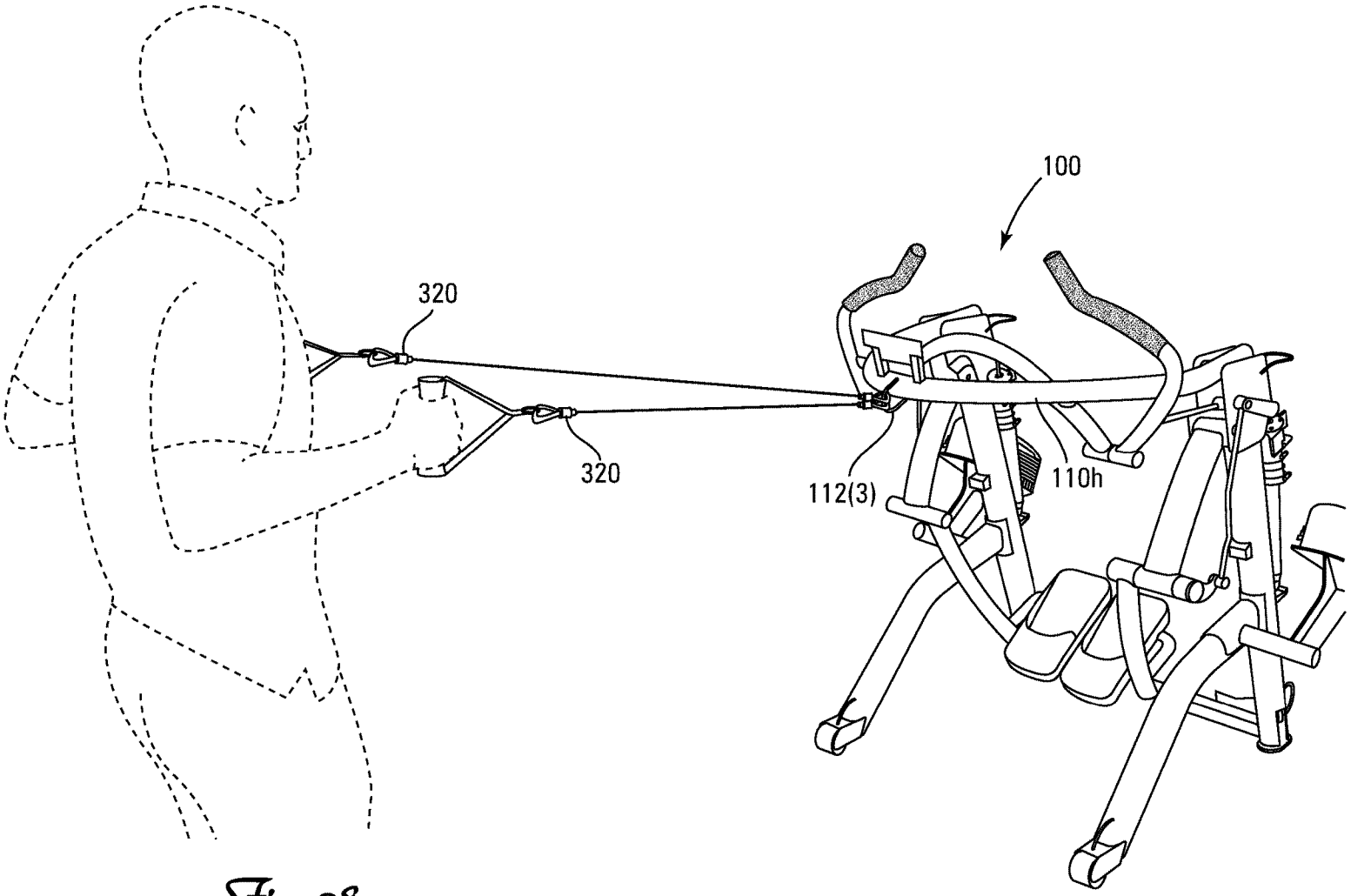
FIG. 38 is a front view of the invention depicted in FIG. 26 with a suited user performing a strength training exercise using the pair of elastic band exercise handles attached to the D-ring on the handrail.

132 Calf Motion Biased Damping System
132*u* Calf Biased Damping Means (e.g., Hydraulic Extension Damped Spring Contraction Biased Piston and Cylinder)
132*v* Interconnect Member
132*w* Bell Crank
134 Bell Crank Stop
140 Control Console
220 Arm Linkages
221 Articulating Arm Member
221*a* Upper End of Articulating Arm Members
221*b* Lower End of Articulating Arm Members
221*r* Right Articulating Arm Member
221*s* Left Articulating Arm Member
222 Arm Articulation Members
222*r* Right Arm Articulation Member
222*s* Left Arm Articulation Member
310 Selectorized Dumbells
320 Elastic Band Exercise Handles
$P_1$ Hip Pivot Points
$P_{1r}$ Right Hip Pivot Point
$P_{1s}$ Left Hip Pivot Point
$P_{1x}$ Lateral Axis Through Hip Pivot Points
$P_2$ Knee Pivot Points
$P_{2r}$ Right Knee Pivot Point
$P_{2s}$ Left Knee Pivot Point
$P_{3r}$ Right Thigh Member—Thigh Articulator Member Pivot Point
$P_{3s}$ Left Thigh Member—Thigh Articulator Member Pivot Point
$P_{4c}$ Center Pivot on Transfer Bar
$P_{4r}$ Right Pivot on Transfer Bar
$P_{4s}$ Left Pivot on Transfer Bar
$P_{5r}$ Right Calf Member Extension Arm—Interconnect Member Pivot Point
$P_{5s}$ Left Calf Member Extension Arm—Interconnect Member Pivot Point
$P_{6a}$ First End Pivot on Bell Crank
$P_{6b}$ Second End Pivot on Bell Crank
$P_{6c}$ Center Pivot on Bell Crank
$P_7$ Calf Biased Damper—Frame Pivot Point
$P_{8r}$ Right Articulating Arm Member Pivot Point
$P_{8s}$ Left Articulating Arm Member Pivot Point
$P_{8x}$ Lateral Axis Through Articulating Arm Member Pivot Points
$P_{9r}$ Right Articulating Arm Member—Arm Articulation Member Pivot Point
$P_{9s}$ Left Articulating Arm Member—Arm Articulation Member Pivot Point
$P_{10r}$ Right Arm Articulation Member—Thigh Member Pivot Point
$P_{10s}$ Left Arm Articulation Member—Thigh Member Pivot Point
x Lateral Direction
y Longitudinal Direction
z Transverse Direction
H Human or User Construction With reference to the illustrative drawings, and particularly to FIGS. 1-38, the invention is directed to a lower body mimetic stationary exercise machine 100 with fully or partially autonomous right and left leg linkages 120 and ergonomically positioned hip $P_1$ and/or knee $P_2$ pivot points. The autonomous links on the leg linkages 120 preferably communicate with a biased damping system 132 configured and arranged for damping or resisting movement of the autonomous link when a user H applies motive, typically downward, force to the corresponding foot support 124, and biasing the autonomous link to follow movement of the user H when the user H is moving away, typically lifting, from the corresponding foot support 124.

Referring generally to FIGS. 1-8, the lower body mimetic stationary exercise machine 100 is symmetrical about the midsagittal plane of the machine 100 so as to provide mirror image right (r) and left (s) sides. For simplicity the detailed discussion will generally collectively reference the right (r) and left (s) components, while the drawings will generally call-out the corresponding right (r) and left (s) components individually.

The machine 100 a lower body mimetic stationary exercise machine that includes a frame 110, leg linkages 120, power transmission systems 130, and a control console 140. The machine 100 optionally and preferably also includes arm linkages 220 and component for facilitating access and usage of strength training components such as selectorized dumbbells 310 and elastic band exercise handles 320.

The exercise machine 100 includes a frame 110. An exemplary frame 110, depicted generally in FIGS. 1-8, defines a relatively inaccessible forward end 100*a* of the machine 100 and an accessible rearward end 100*b* of the machine 100 defining an access opening 119 in the frame 110. The frame 110 includes longitudinally y extending right and left stanchions 110*r* and 110*s* proximate the rear 110*b* of the frame 110, a laterally x extending step-over support beam 110*t* interconnecting the base of the right and left stanchions 110*r* and 110*s*, a horizontal looped handrail 110*h* interconnecting the top of the right and left stanchions 110*r* and 110*s*, a laterally x extending vertical looped cross-beam handrail 110*v* attached to the forward end of the horizontal looped handrail 110*h*, and transversely z extending support leg 110*w* extending forward from each of the right and left stanchions 110*r* and 110*s*.

The exercise machine 100 includes right and left leg linkages 120*r* and 120*s*. An exemplary pair of leg linkages 120 is depicted generally in FIGS. 1-8. Each leg linkage 120 includes a thigh member 121 pivotally attached proximate the upper end 121*a* to the frame 110 at a hip pivot point $P_1$, a calf member 122 pivotally attached proximate the upper end 122*a* to the lower end 121*b* of the thigh member 121 at a knee point $P_2$, and a foot support 124 attached to the lower end 122*b* of the calf member 122. The right and left hip pivot points $P_{1r}$ and $P_{1s}$ define a lateral hip pivot axis $P_{1x}$ that remains static during use of the machine 100.

Elastic stops 116, preferably of high durometer rubber, may be provided on the forward surface of the right and left stanchions 110*r* and 110*s* to prevent the thigh members 121*r* and 121*s* from over-rotating and striking the right and left stanchions 110*r* and 110*s*.

The thigh member 121, calf member 122, and foot support 124 should be configured and arranged such that (1) the lateral hip pivot axis $P_{1x}$ will pass through or posterior to the hip region of an orthostatic forward facing suited user H supported upon the foot supports 124 with the foot supports 124 horizontally and vertically aligned, and/or (2) each of the knee pivot points $P_2$ are positioned proximate the corresponding knee of an orthostatic forward facing suited user H supported upon the foot supports 124 with the foot supports 124 horizontally and vertically aligned.

Each of the right and left thigh members 121*r* and 121*s* and right and left calf members 122*r* and 122*s* members on the right and left leg linkages 120*r* and 120*s* should be connected to a power transmission system selected from a left-right motion transfer system 131 or a biased damping system 132. The exemplary machine 100 depicted in FIGS.

1-38 employs a left-right motion transfer system 131 for the thigh members 121 and a biased damping system 132 for the calf members. Other combinations are possible, such as employing a biased damping system 132 for the thigh members 121 and a left-right motion transfer system 131 for the calf members, employing a left-right motion transfer system 131 for both the thigh members 121 and the calf members 122, and employing a biased damping system 132 for both the thigh members 121 and the calf members 122. Each of these combinations possesses certain unique refinements in interaction between the machine and its human operator.

An exemplary left-right motion transfer system 131 deployed in connection with the thigh members 121 is depicted generally in FIGS. 6, 7 and 18-20. Right and left articulator members 131*r* and 131*s* are pivotally attached at a first end 131$r_1$ and 131$s_1$ to a second tab 121$t_2$ projecting from the upper end 121*a* of the respective right and left thigh members 121*r* and 121*s*, at right and left pivot points $P_{3r}$ and $P_{3s}$. The articulator members 131*r* and 131*s* can be conveniently and protectively housed within the corresponding stanchion 110*r* and 110*s* for extension down to the bottom of each stanchion 110*r* and 110*s* proximate the step-over support beam 110*t*.

The right and left articulator members 131*r* and 131*s* are each pivotally attached at the other end 131$r_2$ and 131$s_2$ to opposite ends 131$t_1$ and 131$t_2$ of a laterally x extending center pivot motion transfer bar 131*t* for pivoting about pivot points $P_{4r}$ and $P_{4s}$ respectively. The center pivot motion transfer bar 131*t* is centrally pivotally attached to the step-over support beam 110*t* at pivot point $P_{4c}$, whereby longitudinal y reciprocation of one articulator members 131, effected by user H induced movement of one of the thigh members 121, effects pivoting of the center pivot motion transfer bar 131*t* about pivot point $P_{4c}$, thereby producing an equal and opposite longitudinal y reciprocation of the other articulator member 131 and hence a corresponding pivoting of the other thigh member 121 about the corresponding hip pivot point $P_1$.

An exemplary biased damping system 132 deployed in connection with the calf members 122 is depicted generally in FIGS. 5-8 and 14-17. Pivotal movement of each calf member 122*r* and 122*s* is independently communicated to and controlled by a biased damping means 132*u*, such as a hydraulic extension damped spring contraction biased piston and cylinder depicted in the figures, through a calf member extension arm 123, an interconnect member 132*v* and a bell crank 134 pivotally attached at a center pivot point $P_{6c}$ to the frame 110 proximate the top of the corresponding stanchion 110*r* and 110*s*.

The calf member extension arm 123 is rigidly affixed to the calf member 122 for pivoting with the calf member 122 about the knee pivot point $P_2$. The distal end of the extension arm 123 is pivotally attached to one end of the interconnect member 132*v* for pivoting about a pivot point $P_5$. The other end of the interconnect member 132*v* is pivotally attached to one end of the bell crank 134 for pivoting about a first pivot point $P_{6a}$ on the bell crank 134. The other end of the bell crank 134 is pivotally attached to the biased damping means 132*u* for pivoting about a second pivot point $P_{6b}$, which for the embodiment illustrated in the Figures is the piston rod component of a hydraulic extension damped spring contraction biased piston and cylinder. The opposite end of the damping means 132*u* is pivotally attached to the frame for pivoting about pivot point $P_7$ to accommodate the modest transverse x movement imposed upon the damping means 132*u* by pivoting of the bell crank 134.

A variety of suitable biased damping devices, either integrated into a single device or employed as separate biasing and damping devices, are readily commercially available from a number of sources. Selection of biasing and damping forces exerted by the biased damping means 132*u* to attain the desired level of interaction between user H and machine 100 depends in large measure upon the size of the intended user H and the configuration of the machine 100, particularly those aspects of machine 100 design that impact the size of the various lever arms on the machine 100 that communicate with the biased damping means 132*u*. By way of example, a hydraulic damped spring biased piston and cylinder having the following performance specifications has been found to be suitable for use with an exercise machine 100 having the dimensions set forth in FIG. 5. A force adjustable biased damping means 132*u* is preferred as it permits user H customization of this feature based upon user H height, weight, age, fitness level, etc. as well as personal preferences.

Damper Force:
At Minimum Selling: 55±5 Kgf
At Maximum Setting: 145±10 Kgf
With The Following Test Parameters:
at a Temperature of 25-30° C.
with Spring Installed
Initial Length: 540 mm Eyelet Center To Eyelet Center
Final Length: 640 mm Eyelet Center To Eyelet Center
Crank Speed of Crank Slider Test Set-Up: 29.4 rpm
Equivalent Peak Velocity: 155 mm/sec
Spring Force:
Spring Rate: 7 lbs/in
initial SPRING FORCE: 35 lbs force In operation, pivoting of the calf member 122 about the knee pivot point $P_2$, and to a lesser extent movement of the knee pivot point $P_2$ relative to the frame 110 as a result of pivoting of the corresponding thigh member 121 about the hip pivot point $P_1$, produces a relatively linear longitudinal y translation of the interconnect member 132*v*. Such linear movement of the interconnect member 132*v* causes the bell crank 134 to pivot about the center pivot point $P_{6c}$ and thereby effect relatively linear longitudinal y translation of the piston within the cylinder in the opposite direction.

Elastic stops 134, preferably of high durometer rubber, may be provided on the rearward surface of the right and left stanchions 110*r* and 110*s* to prevent the bell crank 132*w* from over-rotating and striking the right and left stanchions 110*r* and 110*s*.

The exercise machine 100 is equipped with a control console 140 equipped with a display and a user input device in accordance with standard industry practice. The console 140 may conveniently be mounted onto the forward end of the horizontal looped handrail 110*h* facing the access opening 119 in the rear of the machine 100.

The machine 100 is optionally but preferably equipped with articulating arm linkages 220 for permitting upper body exercise. Articulation of the articulating arm linkages 220 is preferably linked to movement of the leg linkages 120. An exemplary articulating arm linkage is depicted generally in FIGS. 1-10, 12 and 13. Right and left articulating arm members 221*r* and 221*s* are pivotally attached at a lower end 221*b* proximate the right and left ends of the vertical looped cross beam handrail 110*v* for pivoting about right and left pivot points $P_{8r}$ and $P_{8s}$ respectively. Right and left arm articulation members 222*r* and 222*s* are pivotally attached at one end to the corresponding articulating arm member 221*r* and 221*s* for pivoting about pivot point $P_{9r}$ and $P_{9s}$ respectively. The other end of the articulation members 222*r* and

222*s* are pivotally attached to a first tab 121*t*$_1$ projecting from the upper end 121*a* of the respective right and left thigh members 121*r* and 121*s* for pivoting about pivot point $P_{10r}$ and $P_{10s}$ respectively.

In operation, pivoting of a thigh member 121 about the hip pivot point $P_1$, produces a relatively linear transverse z translation of the connected articulation member 222. Such linear movement of the articulation member 222 causes the attached articulating arm member 221 to pivot about pivot point $P_8$, thereby producing forward and back reciprocation of the articulation member 222 in a transverse z direction that is opposite that of the interconnected thigh member 121.

Referring to FIGS. 1-4, protective shrouding 118*r* and 118*s* should be provided over the leg linkage power transmission hubs located proximate the upper end of the right and left stanchions 110*r* and 110*s* respectively. Protective shrouding 118*t* should also be provided over the transfer bar 131*t* on the step-over support beam 110*t*.

D-rings 112 or similar connective devices can be provided on the frame 110 for connecting elastic band exercise handles 320 or other similar strength training devices to the frame 110. FIGS. 1-8, 24-26 and 35-38 illustrate exemplary placement of D-rings 112 on the frame 110 with a first pair 112$_1$ at the lower ends of the right and left stanchions 110*r* and 110*s*, a second pair 112$_2$ at the upper ends of the right and left stanchions 110*r* and 110*s*, and a lone ring 112$_3$ at the lateral x center of the horizontal looped handrail 110*h*.

As illustrated in FIGS. 23, 24 and 33-38, shelves 114 can be provided on each side of the frame 110 for supporting free weights such as selectorized dumbbells 310 at a readily accessible and convenient location.

We claim:

1. An exercise device having (-) a frame with a forward end and a rearward end wherein the frame is configured and arranged to accommodate user access onto the exercise device from the rearward end, (-) left and right leg linkages, each including (i) an upper leg member pivotally coupled to the frame for pivoting about an upper pivot point, with the upper pivot point of each leg linkage defining a point on a laterally extending upper pivot axis that passes through the upper pivot point of each leg linkage, and (ii) a lower leg member directly pivotally coupled to the upper leg member distal to the upper pivot point for pivoting about a lower pivot point, and (-) a foot support attached to each lower leg member distal to each respective lower pivot point, characterized by an ergonomically synergistic combination of:

(a) an interconnection of the upper leg members for synchronized out of phase pivoting about each respective upper pivot point, (b) each of the lower leg members being separate and independent for autonomous pivoting of each of the lower leg members relative to each other about each respective lower pivot point, and (c) a joint-pivot spatial correlation selected from at least one of:

(i) a location of the upper pivot axis configured to pass through or posterior to the hip region of an orthostatic forward facing suited user supported upon the foot supports with the foot supports horizontally and vertically aligned, and (ii) a location of each of the lower pivot points configured to be respectively proximate to one of the knees of the orthostatic forward facing suited user supported upon the foot supports with the foot supports horizontally and vertically aligned.

2. The exercise device of claim 1 wherein the joint-pivot spatial correlation is a location of the upper pivot axis configured to pass through or posterior to the hip region of the orthostatic forward facing suited user supported upon the foot supports with the foot supports horizontally and vertically aligned.

3. The exercise device of claim 1 wherein the joint-pivot spatial correlation is a location of each of the lower pivot points configured to be respectively proximate to one of the knees of the orthostatic forward facing suited user supported upon the foot supports with the foot supports horizontally and vertically aligned.

4. The exercise device of claim 1 wherein the joint-pivot spatial correlation is both (i) a location of the upper pivot axis configured to pass through or posterior to the hip region of the orthostatic forward facing suited user supported upon the foot supports with the foot supports horizontally and vertically aligned, and (ii) a location of each of the lower pivot points configured to be respectively proximate to one of the knees of the orthostatic forward facing suited user supported upon the foot supports with the foot supports horizontally and vertically aligned.

5. The exercise device of claim 1 wherein each lower leg member communicates with a biased damping means for biased pivoting of each lower leg member about each respective lower pivot point towards a first direction and damped pivoting of each lower leg member about each respective lower pivot point in a second direction opposite the first direction.

6. The exercise device of claim 5 wherein a biasing force exerted by each of the biased damping means is adjustable.

7. The exercise device of claim 5 wherein a damping force exerted by the biased damping means is adjustable.

8. The exercise device of claim 6 wherein a damping force exerted by the biased damping means is adjustable.

9. The exercise device of claim 1 further comprising a control console attached to the frame proximate to the forward end of the frame.

10. The exercise device of claim 1 wherein (i) each upper leg member pivots about the respective upper pivot point and is coupled to the respective lower leg member which pivots about the respective lower pivot point, and (ii) each upper leg member pivots about the respective upper pivot point autonomously relative to pivoting of the respective lower leg member about the respective lower pivot point, whereby (iii) pivoting of each upper leg member about the respective upper pivot point effects pivoting of the respective lower pivot point about the upper pivot point without inducing pivoting of the respective lower leg member about the respective lower pivot point.

11. The exercise device of claim 1 wherein (i) each lower leg member pivots about the respective lower pivot point and is coupled to the respective upper leg member which pivots about the respective upper pivot point, and (ii) each lower leg member pivots about the respective lower pivot point autonomously relative to pivoting of the respective upper leg member about the respective upper pivot point, whereby (iii) pivoting of each lower leg member about the respective lower pivot point does not induce pivoting of the respective upper leg member about the respective upper pivot point.

12. The exercise device of claim 10 wherein each lower leg member pivots about the respective lower pivot point autonomously relative to pivoting of the respective upper leg member about the respective upper pivot point, whereby pivoting of each lower leg member about the respective lower pivot point does not induce pivoting of the respective upper leg member about the respective upper pivot point.

13. An exercise device having (-) a frame with a forward end and a rearward end wherein the frame is configured and arranged to accommodate user access onto the exercise device from the rearward end, (-) left and right leg linkages, each including (i) an upper leg member pivotally coupled to the frame for pivoting about an upper pivot point, with the upper pivot point of each leg linkage defining a point on a laterally extending upper pivot axis that passes through the upper pivot point of each leg linkage, and (ii) a lower leg member directly pivotally coupled to the upper leg member distal to the upper pivot point for pivoting about a lower pivot point, and (-) a foot support attached to each lower leg member distal to each respective lower pivot point, characterized by an ergonomically synergistic combination of:

(a) an interconnection of the upper leg members for synchronized out of phase pivoting about each respective upper pivot point, (b) each of the lower leg members being separate and independent for autonomous pivoting of each of the lower leg members relative to each other about each respective lower pivot point, and (c) a biased damping system for effecting biased pivoting of each lower leg member about each respective lower pivot point towards a first direction and damped pivoting of each lower leg member about each respective lower pivot point in a second direction opposite the first direction.

* * * * *